US010329841B2

(12) United States Patent
Van Duivendijk et al.

(10) Patent No.: US 10,329,841 B2
(45) Date of Patent: Jun. 25, 2019

(54) WELLBORE DRILLING WITH A TROLLEY AND A TOP DRIVE DEVICE

(71) Applicant: ITREC B.V., Schiedam (NL)

(72) Inventors: Pieter Dirk Melis Van Duivendijk, Schiedam (NL); Diederick Bernardus Wijning, Schiedam (NL); Nicolaas Thijs Pieter Max, Schiedam (NL); Jasper Hendrik Frank Bakker, Schiedam (NL); Adriaan Van Swieten, Schiedam (NL); Joop Roodenburg, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 15/767,518

(22) PCT Filed: Oct. 7, 2016

(86) PCT No.: PCT/NL2016/050697
§ 371 (c)(1),
(2) Date: Apr. 11, 2018

(87) PCT Pub. No.: WO2017/065604
PCT Pub. Date: Apr. 20, 2017

(65) Prior Publication Data

US 2018/0298695 A1 Oct. 18, 2018

(30) Foreign Application Priority Data

Oct. 12, 2015 (NL) ..... 2015604
Oct. 12, 2015 (NL) ..... 2015605
Jun. 15, 2016 (NL) ..... 2016971

(51) Int. Cl.
*E21B 3/02* (2006.01)
*E21B 15/00* (2006.01)
(Continued)

(52) U.S. Cl.
CPC ..... *E21B 3/02* (2013.01); *E21B 15/00* (2013.01); *E21B 15/04* (2013.01); *E21B 19/008* (2013.01);
(Continued)

(58) Field of Classification Search
CPC . E21B 3/02; E21B 15/00; E21B 15/02; E21B 19/06; E21B 19/146; E21B 19/155;
(Continued)

(56) References Cited

U.S. PATENT DOCUMENTS 6,857,483 B1 2/2005 Dirks et al.
7,493,970 B1 * 2/2009 McKnight, Jr. ..... E21B 3/02 175/113
(Continued)

FOREIGN PATENT DOCUMENTS

EP 0 525 247 A1 2/1993
GB 1 294 066 10/1972
(Continued)

OTHER PUBLICATIONS

International Search Report, issued in PCT/NL2016/050697, dated Dec. 14, 2016.
(Continued)

*Primary Examiner* — Matthew R Buck
(74) *Attorney, Agent, or Firm* — Birch, Stewart, Kolasch & Birch, LLP

(57) ABSTRACT

A method for removal of a top drive device in a wellbore drilling installation, e.g. for servicing and/or exchanging a top drive device. The frame of the trolley and the top drive device are provided with cooperating vertical guide members so that the top drive device is vertically displaceable and guided relative to the frame. The top drive device has an operative position above the rotatable head clamp assembly carrier, which is releasably connected to first and second
(Continued)

Figure 1:
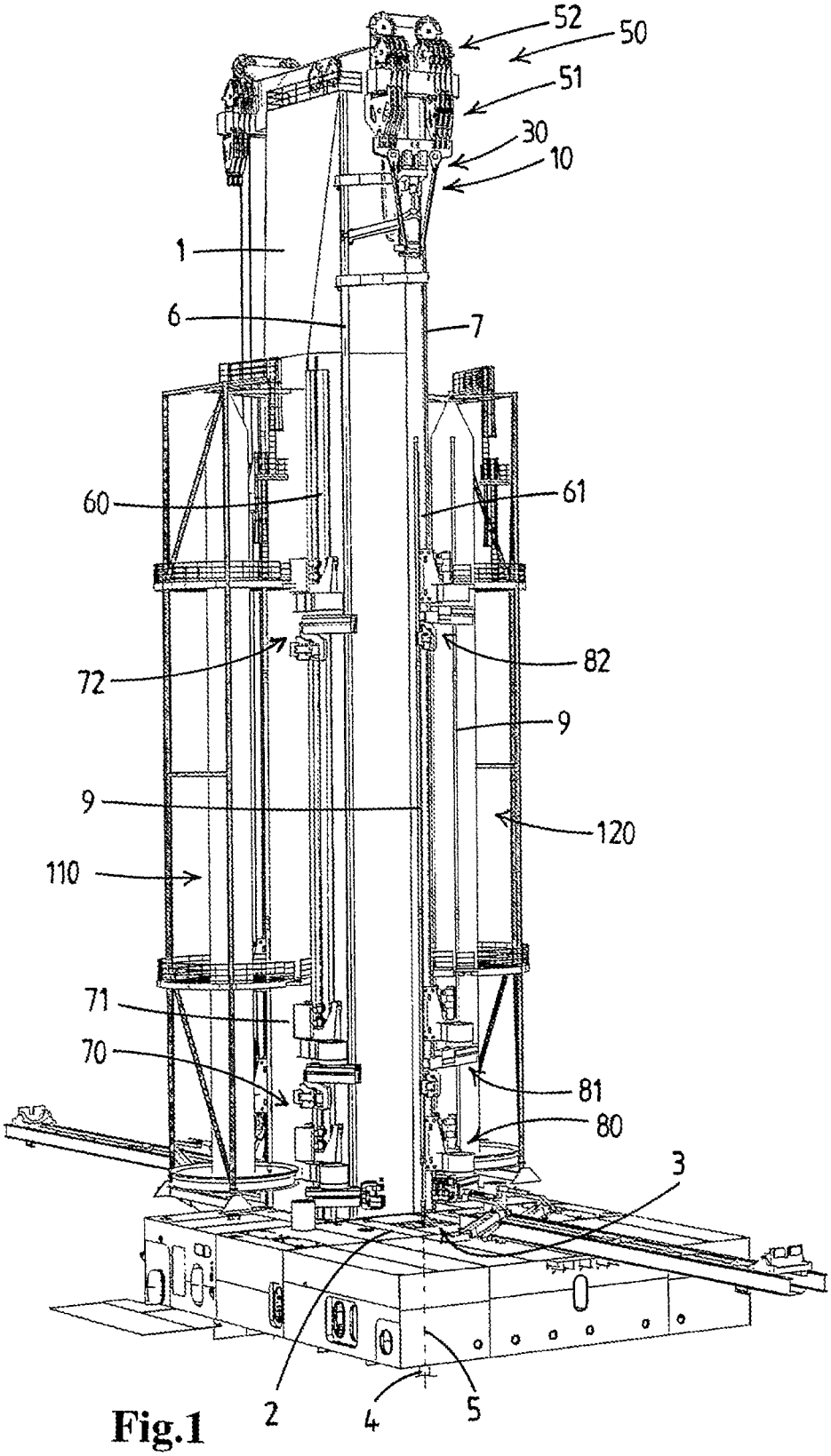

vertical frame members. In order to service and/or exchange of the top drive device, the method includes releasing the rotatable head clamp assembly carrier from the first and second frame members, removing the rotatable head clamp assembly carrier, lowering the top drive device relative to the frame of the trolley until the cooperating vertical guide members thereof disengage, moving the lowered and disengaged top drive device to a service and/or storage location remote from the firing line.

13 Claims, 22 Drawing Sheets

(51) Int. Cl.

| | |
|---|---|
| ***E21B 15/02*** | (2006.01) |
| ***E21B 15/04*** | (2006.01) |
| ***E21B 19/06*** | (2006.01) |
| ***E21B 19/08*** | (2006.01) |
| ***E21B 19/14*** | (2006.01) |
| ***E21B 19/15*** | (2006.01) |
| ***E21B 19/16*** | (2006.01) |
| ***E21B 19/00*** | (2006.01) |
| *E21B 17/03* | (2006.01) |

(52) U.S. Cl.
CPC ..... *E21B 19/06* (2013.01); *E21B 19/08* (2013.01); *E21B 19/14* (2013.01); *E21B 19/146* (2013.01); *E21B 19/155* (2013.01); *E21B 19/16* (2013.01); *E21B 17/03* (2013.01)

(58) Field of Classification Search
CPC ..... E21B 15/04; E21B 19/008; E21B 19/08; E21B 19/14; E21B 19/16
See application file for complete search history.

(56) References Cited

U.S. PATENT DOCUMENTS

| | | | | |
|---|---|---|---|---|
| 7,584,810 | B1 * | 9/2009 | McKnight, Jr. ..... | E21B 15/00 175/162 |
| 8,607,898 | B2 * | 12/2013 | Rodgers ..... | E21B 3/02 166/85.1 |
| 9,010,410 | B2 * | 4/2015 | Story ..... | E21B 3/02 166/77.52 |
| 2003/0159853 | A1 | 8/2003 | Archibald et al. | |
| 2005/0173154 | A1 | 8/2005 | Lesko | |
| 2005/0279507 | A1 * | 12/2005 | Folk ..... | E21B 19/08 166/378 |
| 2006/0191689 | A1 * | 8/2006 | Severin ..... | E21B 19/06 166/379 |
| 2011/0280104 | A1 | 11/2011 | McClung, III | |
| 2012/0217066 | A1 | 8/2012 | Smith et al. | |
| 2013/0090200 | A1 | 4/2013 | Richardson | |
| 2013/0133900 | A1 | 5/2013 | Sredensek | |

FOREIGN PATENT DOCUMENTS

| | | | |
|---|---|---|---|
| WO | WO 2005/028808 | A1 | 3/2005 |
| WO | WO 2006/059153 | A1 | 6/2006 |
| WO | WO 2014/178709 | A1 | 11/2014 |
| WO | WO 2014/182160 | A2 | 11/2014 |
| WO | WO 2014/186889 | A1 | 11/2014 |
| WO | WO 2014/193228 | A2 | 12/2014 |
| WO | WO 2015/133895 | A1 | 9/2015 |
| WO | WO 2015/133896 | A1 | 9/2015 |
| WO | WO 2015/143329 | A1 | 9/2015 |

OTHER PUBLICATIONS

International Search Report, issued in PCT/NL2017/050165, dated Jun. 6, 2017.
International Search Report, issued in PCT/NL2017/050396, dated Oct. 18, 2017.
Written Opinion of the International Searching Authority, issued in PCT/NL2016/050697, dated Dec. 14, 2016.

* cited by examiner

WELLBORE DRILLING WITH A TROLLEY AND A TOP DRIVE DEVICE

The present invention relates to wellbore drilling installation with a trolley and a top drive device, e.g. mounted on an offshore drilling vessel.

The present invention also relates to the serviceability and to servicing of a top drive device of a wellbore drilling installation, e.g. mounted on an offshore drilling vessel.

In WO2014/182160 an offshore vessel with a wellbore drilling installation is disclosed which comprises:

drilling tower, a drill floor having a well center through which a drilling tubulars string can pass along a firing line, at least one vertical trolley rail supported by the drilling tower, a trolley, said trolley being guided along said at least one vertical trolley rail, a main hoisting device adapted to move the trolley with the top drive device up and down along said at least one vertical trolley rails, and a top drive device attached to the trolley, said top drive device comprising one or more top drive motors, e.g. electric top drive motors, and a rotary stem or quill extending in said firing line and being driven by said one or more motors in order to impart rotary motion to a drilling tubulars string when connected to said top drive.

In WO2014/178709 a wellbore drilling installation is disclosed wherein the trolley comprises a frame with a top frame member suspended from one or more winch driven cables of a main hoisting device, and with first and second vertical frame members that are each connected at an upper end thereof to the top frame member. These first and second vertical frame members depend from the top frame member at locations that are spaced apart from one another. The top drive device is attached to the frame via bails that are attached to the gearbox of the top drive and a hook arrangement on the top frame member. Thereby the top drive device is supported by the frame independent from the first and second vertical members. These first and second vertical members carry at their lower ends a cross beam which supports, in an embodiment, a rotatable tubular stem via a thrust bearing. The stem is adapted to be connected, via a threaded portion at its lower end, to the top end of a drilling tubulars string that passes along the firing line into the wellbore. The top drive device is connectable to the upper end of the tubular stem so that drilling can be performed by rotating the drilling tubulars string. The load of a drilling tubulars string is transmitted via the thrust bearing and the cross beam to the first and second vertical frame members and thereby to the top frame member that is suspended from the main hoisting device.

In the field, especially in the offshore drilling field, downtime due to equipment failure is considered a major issue. Whilst a drilling or other wellbore related operation involves the use of numerous pieces of equipment, studies seem to indicate that the top drive device is one of the major contributors to undesirable downtime.

The company LeTourneau Technologies Drilling Systems Inc. identified the gearbox as crucial component in this regard and has developed a hollow shaft electric drive motor that acts as a direct drive for the rotary output stem or quill that is driven by the motor. This eliminates the gearbox yet requires a special design of the motor. It is noted that such a direct drive design of the quill is also an option within the scope of the present invention, yet traditionally, and also within the scope of the present invention, the top drive device may include one or more motors connecting to a gearbox or transmission housing.

In US20130090200 the issue of top drive reliability is also addressed and an alternative structure of the transmission between the electric motors and the rotary quill is disclosed.

Other developments in the field concentrate on enhanced maintenance schedules for equipment, including of the top drive, to prevent failures from occurring.

Notwithstanding the efforts made so far to reduce downtime, failures of top drive devices still occur at the expense of very costly downtime of the drilling installation.

The present invention aims to propose measures that allow to reduce the downtime due to top drive failure and/or allow enhanced, e.g. more efficient, wellbore activities, e.g. exchanging one top drive device for another top drive device, efficient switching between drilling and tripping (out), efficient drilling with casing, etc.

According to a first aspect thereof the invention provides a wellbore drilling installation for drilling a wellbore or other wellbore related activities according to claim 1. The installation comprises one or more carts, each adapted to transport a component to be suspended from the first and second vertical frame members, wherein each cart is adapted to be positioned on the drill floor underneath the trolley, e.g. over the well center, so that the installation is operable to allow for removal of a component suspended from the first and second vertical frame members by a routine including the steps of:

positioning a cart on the drill floor underneath the trolley, lowering the trolley by means of the main hoisting device and bringing the component to rest on the cart, releasing the component from the lower connector members of the first and second vertical frame members, moving away the cart with the released component to a remote location, and so that the installation is operable to allow for the mounting of a component to be suspended from the first and second vertical frame members of the trolley by a routine including the steps of:

moving a cart carrying the component from a remote location to a position on the drill floor underneath the trolley, coupling said component with the lower connector members of the first and second vertical frame members, lifting the component from the cart, e.g. by raising the trolley, moving the empty cart to a remote location.

In an embodiment the cart(s) is/are embodied to travel over rails on the drill floor and, e.g. in practical embodiments in an offshore drilling vessel, said rails also may extend over an adjoining deck area of the vessel. For example the rails form part of a grid of orthogonal rail sections that have junctions connecting the rail sections, e.g. a first cart rail section includes a pair of parallel cart rails passing along the well center of the drill floor, and a second cart rail section that is orthogonal to said first cart rail section. For example said first cart rail section extends transverse to the hull of a monohull drilling vessel and the second cart rail section extends along a side of the hull. Other arrangements are also possible.

The drill floor may e.g. extend over a moonpool in an offshore drilling vessel. In an embodiment the drill floor is movable, e.g. vertically by suspending the drill floor from the trolley (e.g. by connecting to said first and second frame members), e.g. to allow a BOP or other subsea equipment to be brought into the moonpool while the drill floor is in a raised position. The drill floor may thus be provided with connectors that are adapted to mate with the lower connectors of the first and second vertical frame member of the trolley. In another embodiment the drill floor is pivotal or slidable in order to open the moonpool for access of the BOP or other large subsea equipment into the moonpool.

In an embodiment the main hoisting device includes a heave compensation system, e.g. a heave compensation mechanism is provided that acts on one or more cables from which the trolley is suspended relative to the drilling tower in order to afford heave compensation of the trolley and any attached components, including the attached top drive device. Heave compensation may be passive and/or active as is known in the art. In view of effective height it is preferred for any heave compensation system to be located between the one or more winches and the crown block, and/or be embodied as control of the respective winch or winches, when such main hoisting device is present, so as to allow maximum travel of the trolley up to the crown block, e.g. in view of handling tall stands of tubulars, e.g. stands of 4, 5, or even six tubular joints (e.g. 180 ft. stands). So it is preferred that no heave compensation device is present in or on the trolley, e.g. between a travelling block and the trolley. Such arrangements would take up height in undesirable manner.

As will be explained herein, in embodiments, the trolley and top drive device may be embodied to allow for some operational vertical motion of the top drive device relative to the trolley frame during operational use, e.g. in view of make-up and break-up of a (screw threaded) connection between a rotary stem or quill of the top drive device and the top end of the drilling tubular axially retained by a rotatable head clamp. For such operations a vertical travel range of e.g. at most 1 meter will suffice in practice.

A cart for transporting a component and/or the top drive device may be embodied as a skid cart travelling over skid rails, e.g. with a skid mechanism to advance the cart. A skid cart embodiment is, for example, advantageous in combination with the handling of the top drive device by means of such a cart, taking into account the significant weight and size of a top drive device, e.g. in offshore (deep water) drilling. Similar reasoning applies when it is envisaged that one or more tall and heavy firing line components are to be suspended from the trolley, e.g. a multistory structural frame provided with a coiled tubing injector and, at a lower level, one or more pressure control devices, possibly also with a wireline unit. Such tall multistory structural frames can be handled by a skid cart.

One or more of the carts may be designed dedicated to a specific component to be transported by the cart, e.g. a dedicated top drive device cart, a dedicated thrust bearing component cart, a dedicated wrench device cart, etc. For example the cart has a cradle which is shaped to receive therein the specific component.

In an embodiment a cart may comprise one or more positioning actuators which are adapted to adjust the position of the component or top drive device relative to the cart, e.g. (slightly) raise or lower the component and/or shift the component sideways and/or adjust the angular orientation (tilt) of the component. For example the one or more positioning actuators are used to fine-tune the position of the component relative to the trolley, e.g. to the first and second vertical frame members thereof in view of establishing a connection to said frame members. Operating one or more cart bound positioning actuators for fine-tuning the positioning of the component and or of the top drive device relative to the trolley may be more effective/fast than trying to do the same by moving the trolley. For example a cart has one or more hydraulic actuators, e.g. connectable to one or more hydraulic lines provided on the drill floor near the well center.

In embodiments the one or more components further comprise one or more of:

- a casing tool including an internal and/or external gripper assembly for gripping casing,
- a casing running tool,
- a casing drive tool, e.g. a casing drive tool that is connectable to the top drive device that provides the rotary power to the casing drive tool,
- a riser lifting tool adapted for use in upending of a riser section to be added to a riser string and/or for lifting an lowering a riser string in subsea wellbore related activities,
- a well intervention apparatus, e.g. including a coiled tubing injector, e.g. a structural frame provided with a coiled tubing injector apparatus, e.g. a multistory structural frame with one or more pressure control devices (BOP's) at a lower level, a coiled tubing injector at a higher level.

It will be appreciated that the above list is non-limiting and that other components used in the drilling industry in the firing line, e.g. above the well center, may also be provided.

In a preferred embodiment the thrust bearing component includes:

- a rotatable head clamp assembly carrier, that is connectable to the lower connectors of the first and second vertical frame members,
- a rotatable head clamp assembly which is supported by, e.g. integrated with, the rotatable head clamp assembly carrier, which rotatable head clamp assembly is provided with an open-centered rotary body with a vertical passage there through that e.g. allows to lower the head clamp assembly from above over a top end of a drilling tubular in said firing line, wherein the rotatable head clamp assembly is provided with a retainer assembly, e.g. a tool joint retainer assembly, that is embodied to axially retain the top end of the drilling tubular, e.g. a tool joint or box member at the top of a drilling tubular or a special sub fitted on a drilling tubular, whilst the top end of the tubular remains accessible for a quill or rotary stem of the top drive device, wherein the rotatable head clamp assembly is provided with a thrust bearing adapted to support the load of the drilling tubulars string during a drilling process, when the quill or rotary stem of the top drive device is connected to the top end of the drilling tubulars string, e.g. by a threaded connection.

The head clamp assembly is primarily envisaged for use during a drilling process, wherein the drilling tubulars string is suspended from the assembly and the top drive is connected to the top end of the string to provide torque to the string, e.g. a drill pipes string or a casing string.

It is envisaged, at least in suitable embodiments, that the same head clamp assembly may also be used during tripping in or out a drilling tubulars string, advantageously allowing to dispense with the presence and use of any tubulars elevator. For example for tripping out a drilling tubulars string the trolley can be lowered so that the top end of the string, held by a slip device, e.g. on or in the drill floor, passes into the open centered rotary body and is then retained by the retainer assembly, e.g. as pivotal retainer members are pivoted to allow for the passage of a tool joint or box member at said top end upward past said retainer members and then the pivotal retainer members move back to a retaining position wherein they engage on a shoulder of the tool joint or box member. Instead of pivoting other motions of the retainer members can be envisaged as well. There is no need to connect the top drive device to the string, in fact in an embodiment the top drive device is removed from the trolley in order to reduce the weight of the trolley and so increase effective hoist capacity of the main hoisting device and/or to perform service on the top drive device removed from the trolley during a tripping run. Then the trolley is hoisted so as to pull a stand of the drilling tubulars out of the wellbore. The slip device is then reengaged with the string and a piperacker device is operated to grip the raised stand, which is then released at its lower end from the string and is released from the head clamp assembly. The released stand is than moved into a storage device or rack for tubular stands by means of the racker device. For tripping in a string into the wellbore the same equipment can be used in reverse manner.

The rotary head clamp assembly may also be used for other activities, e.g. for handling a telescopic joint, a bottomhole assembly, etc. as its load carrying capacity is enormous due to the requirement that it can support the load of the drilling tubulars string.

In practical embodiments the rotary head clamp assembly component may be embodied to handle a vertical load of at least 500 tonnes, or even at least 1000 tonnes, or even at least 1500 tonnes exerted thereon by a drilling tubulars string whilst said string is rotated by the top drive device in a drilling operation.

The thrust bearing component, e.g. including the rotary head clamp assembly, may comprise a built-in lubricating system for at least the thrust bearing and/or a monitoring system for at least the thrust bearing, e.g. to monitor effective load and/or wear and/or temperature of the thrust bearing.

In an embodiment the thrust bearing component is embodied as generally illustrated in WO2014/178709 with a rotary body supported by a thrust bearing and having an integrated stem or quill extending downward from the component in order to be screwed onto the top end of drilling tubular, wherein the rotary body has an upper portion to be connected to the rotary output member of the top drive device, e.g. by a splined connector.

In an embodiment the thrust bearing component has a rotary body supported by a thrust bearing, wherein the vertical passage is provided with an internal locking formation, e.g. a bayonet lock formation, adapted to cooperate with a mating external locking formation of a firing line tool. The tool may e.g. be a quill with threaded lower end, a casing tool, a spear tool, etc. This embodiment envisages the presence of a plurality of different tools being equipped with the same external locking formation, so that a selected tool can be connected to the rotary body, e.g. in a bayonet locking arrangement. In an embodiment the rotary body of the rotatable head clamp as described herein is also provided with an internal locking formation allowing for dual use of the head clamp.

In an embodiment the frame of the trolley and the top drive device are provided with cooperating vertical guide members so that the top drive device is vertically displaceable and guided relative to the frame, wherein the top drive device has an operative position above a component held by the lower connector members of the first and second vertical frame members. The vertical guide members are embodied such that removal of the top drive, e.g. in view of mere removal, servicing, and/or exchange of the top drive device, is allowed or performed by a routine comprising the steps of:

positioning a cart on the drill floor underneath the trolley, lowering the trolley by means of the main hoisting device and bringing the component to rest on the cart, releasing the component from the lower connector members of the first and second vertical frame members, moving away the cart with the released component resting thereon to a remote location, positioning a cart on the drill floor underneath the trolley, lowering the top drive device relative to said frame of said trolley until said cooperating vertical guide members thereof disengage and the bringing the top drive device to rest on the cart, moving the cart with said lowered and disengaged top drive device resting thereon to a remote location, e.g. to a remote service and/or storage location.

Preferably two carts are used in this routine, e.g. one cart dedicated to the component and one cart dedicated to handling and transporting the top drive device.

The vertical guidance of the top drive by the frame of the trolley allows for easy and fast handling and to control the very heavy top drive during its descend, also during its raising when installing the top drive, e.g. onboard a drilling vessel that is subjected to sea state induced motions, e.g. roll, pitch, heave. In embodiments the same vertical guide arrangement also is embodied as a reaction torque absorber, e.g. for the top drive device, the wrench device, and/or the component that is suspended from the first and second vertical frame members. The latter version avoids undue loading of the vertically strained first and second vertical frame members by additional torque and/or avoids undue torsional load on the releasable connection between the component and these frame members.

In embodiments the top drive device is vertically displaceable relative to the frame of the trolley, e.g. guided by cooperating guide members, wherein the trolley is provided with an auxiliary hoisting device adapted to vertically move at least the top drive device relative to the frame. For example the auxiliary hoisting device is adapted to lower the top drive device onto a cart positioned on the drill floor underneath the trolley in the course of removal of the top drive device and to lift the top drive device from a cart positioned on the drill floor underneath the trolley in the course of mounting of the top drive device in the trolley. This will require an auxiliary hoisting device having a capacity corresponding at least to the weight of the top drive device. The auxiliary hoisting device may be permanently fitted on the trolley, so as to be readily available when needed. For example one or more chain or wire hoist devices can be provided on the trolley, having a capacity to handle the top drive device.

In embodiments the first and second vertical frame members are embodied each as a pivotal link member of which the upper end is pivotally connected to the top frame member so that the pivotal link members are pivotal in a common transverse plane that encompasses the firing line. For example each link member has an eye as lower connector member and one or more of the components have opposed hooks that are each engageable with a respective eye of the link member. The pivotal arrangement e.g. allows for easy engagement with a hook on the component and/or allows for the combination with components that have different widths between the respective hooks by placing the link members at varying angular positions. In embodiments the trolley may be equipped with one or more actuators that are adapted to cause controlled pivoting of the first and second vertical frame members, e.g. independent from one another, e.g. in view of connecting and disconnecting a component.

In embodiments the frame of the trolley has one or more vertical guide rails, wherein the top drive device has cooperating guide members, e.g. rollers, that cooperate with the one or more vertical guide rails, wherein one or more of said components comprise a guidance portion that cooperates with said same one or more vertical guide rails, e.g. said one or more vertical guide rails also being embodied to absorb reaction torque of said top drive device and/or of said one or more components equipped with said guidance portion. This dual use of the one or more vertical guide rails e.g. allows for a simpler and lighter structure of the trolley.

In embodiments the installation comprises a pair of parallel vertical trolley rails and the trolley comprises a rigid frame structure having an upper and lower trolley beam, which beams are vertically spaced from another, e.g. each beam being in view from above in V or U shape, and which beams are each equipped at ends thereof with rollers engaging the respective trolley rails. Herein the upper and lower trolley beam are rigidly interconnected by one or more rear frame members, e.g. a single rear frame member as is preferred. Further the rigid frame structure comprises a forward cantilevered frame member extending forward from a top end of said one or more rear frame members. Herein the forward cantilevered frame member carries a transverse horizontal top frame member in a transverse plane that encompasses the firing line. The first and second vertical frame members are each connected at an upper end thereof to said top frame member and depend from said top frame member spaced apart from one another, preferably in said transverse plane, and are adapted to support the load of a drilling tubulars string that passes along said firing line into the wellbore.

In an embodiment the trolley frame exactly has the first and second vertical frame members in order to support the one or more components, e.g. said vertical frame members each having an eye and the component having a pair of opposed hooks, e.g. forged steel hooks, that are engageable with said eyes. Herein, as preferred, stability of the component is enhanced by the component having a guidance portion, e.g. extending to the rear, that cooperates with a vertical guide rail on the trolley. For example said guide rail extends to below the eyes of the first and second frame members so that the component is still connected to the guide rail when the frame members are detached from the component, e.g. by pivoting each frame member laterally away from the respective hook.

In an embodiment the top frame member is provided with connectors, for example holes, for connecting thereto a series of cable sheaves in a side by side arrangement, wherein the drilling tower is provided with a crown block having cable sheaves so that the trolley is suspended by one or more winch driven cables in a multiple fall arrangement.

In embodiments the trolley is further provided with a wrench and/or clamp device that is mounted on the frame of the trolley independent from the top drive device and from the component held by the first and second vertical frame members, at a location below the top drive device and above said component. Preferably the frame of the trolley has one or more vertical guide rails and the top drive device has cooperating guide members, e.g. rollers, that cooperate with the one or more vertical guide rails. Herein the wrench and/or clamp device is vertically guided on said same one or more vertical guide rails as the top drive device, e.g. allowing a routine for removal of the top drive device comprising the steps of:

positioning a cart on the drill floor underneath the trolley,
lowering the trolley by means of the main hoisting device and bringing the component to rest on the cart,
releasing the component from the lower connector members of the first and second vertical frame members,
moving away the cart with the released component resting thereon to a remote location,
positioning a cart on the drill floor underneath the trolley,
lowering the wrench and/or clamp device relative to the frame of said trolley until said wrench and/or clamp device disengages from said one or more vertical guide rails and the bringing the wrench and/or clamp device to rest on the cart,
moving the cart with said lowered and disengaged wrench and/or clamp device resting thereon to a remote location, e.g. to a remote service and/or storage location,
positioning a cart on the drill floor underneath the trolley,
lowering the top drive device relative to said frame of said trolley until said top drive device disengages from said one or more vertical guide rails and the bringing the top drive device to rest on the cart,
moving the cart with said lowered and disengaged top drive device resting thereon to a remote location, e.g. to a remote service and/or storage location.

In embodiments at least one of the carts is embodied with a straddling structure having a top structure embodied to support one or more of said components and with a raised straddle frame, e.g. that has a height of at least 2 meters above the drill floor when the cart is positioned on the drill floor underneath the trolley. This for example allows to place the cart over the well center, and as is preferred, over a stick-up portion of a drilling string held by a slip device.

The first aspect of the invention also relates to a method for performing a wellbore related process, wherein use is made of made of a wellbore drilling installation as described herein.

The first aspect of the invention also relates to a method for operating a wellbore drilling installation as described herein, wherein for removal of a component suspended from the first and second vertical frame members a routine is performed including the steps of:

positioning a cart on the drill floor underneath the trolley,
lowering the trolley by the main hoisting device and bringing the component to rest on the cart,
releasing the component from the lower connector members of the first and second vertical frame members,
moving away the cart with the released component to a remote location.

The first aspect of the invention also relates to a method for operating a wellbore drilling installation as described herein, wherein for the mounting of a component to be suspended from said first and second vertical frame members of the trolley a routine is performed including the steps of:

moving a cart carrying the component from a remote location to a position on the drill floor underneath the trolley,
coupling said component with the lower connector members of the first and second vertical frame members,
lifting the component from the cart, e.g. by raising the trolley,
moving the empty cart to a remote location.

The first aspect of the invention also relates to a method for drilling a wellbore wherein use is made of a wellbore drilling installation including a thrust bearing component with rotatable head clamp assembly as described herein, wherein—during a drilling process—the drilling tubulars string is suspended from the thrust bearing component, e.g. from the rotatable head clamp assembly thereof, so that the load of the drilling tubulars string is transferred via the thrust bearing of the thrust bearing component to the first and second vertical frame members and thereby to said top frame member suspended from said main hoisting device, and wherein the top drive device is connected to the top end of the suspended drilling tubulars string, e.g. by a threaded connection, to impart rotary motion to said string.

The first aspect of the invention also relates to a method for performing a coiled tubing process in a wellbore, wherein use is made of a wellbore drilling installation as described herein, wherein a coiled tubing injector, e.g. a structural frame provided with a coiled tubing injector, is connected to the first and second vertical frame members of the trolley.

A second aspect of the invention proposes a method, wherein, in order to remove the top drive device, e.g. in view of servicing and/or exchange of the top drive device, the method comprises:

- releasing the thrust bearing component from the first and second frame members,
- removing said thrust bearing component,
- lowering said top drive device relative to said frame of said trolley until said cooperating vertical guide members thereof disengage,
- moving said lowered and disengaged top drive device away, e.g. to a service and/or storage location remote from the firing line.

In an embodiment the thrust bearing component includes a rotatable head clamp assembly as described herein.

The method of the present invention allows for a rapid and effective removal of the top drive device from the frame of the trolley, e.g. in order to service the top drive device at a remote location and/or to replace the entire top drive device for another, e.g. spare, top drive device.

The presence of the thrust bearing component, e.g. with the rotatable head clamp assembly, and the design of the trolley frame means that the top drive device can advantageously be designed with relatively small dimensions and weight as the load of the drilling tubulars string in the wellbore is passed via the thrust bearing component, its thrust bearing, the first and second vertical frame members, and the top frame member to the main hoisting device. Thereby this (enormous) load bypasses the top drive device itself which can then be optimized in view of dimensions and weight for use in the inventive installation as is preferred.

The servicing of the top drive device is e.g. preferably conducted in a dedicated service workshop, e.g. onboard the offshore vessel provided with the mentioned wellbore drilling installation, where maintenance work can be done far more effectively than with the top drive device being retained in the trolley and in the firing line. Thereby the time and effort needed for any servicing can be greatly reduced.

In particular nowadays heavy duty top drives are used which include one or more electric motors, e.g. two or four motors, with more than 300 kW power rating each. For example the TDX series top drives of NOV have two AC induction motors of over 1000 kW each. These motors are fitted on top of a transmission housing, with the rotary stem or quill projecting below said transmission housing. The transmission housing is connected to two bails that allows to suspend the top drive from a hook of a winch and cable type main hoisting device. At the rear of the top drive a sliding trolley is fitted, that slides along one or more vertical guide rails. These known top drive devices include the high capacity thrust bearing and the housing is embodied to support to entire drilling tubulars string load, e.g. at a rating of 1000 ton or above. Whilst the invention does not exclude the presence of such a known top drive device in the trolley frame, it is preferred to have a lighter and smaller top drive device as there is no need for the top drive device to absorb the drilling tubulars string load.

In an embodiment the method of the second aspect of the invention comprises the use of a cart, e.g. a skiddable cart or a wheeled cart, wherein the method further comprises:

- positioning of the cart underneath the trolley, e.g. in a practical embodiment on the drill floor over the well center,
- lowering the trolley by the main hoisting device and bringing the thrust bearing component, e.g. the rotatable head clamp assembly carrier, to rest on said cart, e.g. the lowering being continued until the component rests on the cart and/or the cart having a liftable support or cradle for the component that is made to engage the carrier,
- releasing the component, e.g. the rotatable head clamp assembly carrier, from the first and second frame members, and
- moving away the cart with the released component, e.g. rotatable head clamp assembly carrier, e.g. to a remote storage and/or maintenance location.

In embodiment it is preferred for the head clamp assembly to remain integrated with the carrier during these steps.

In an embodiment the trolley is provided with an auxiliary hoisting device adapted to vertically move at least the top drive device relative to the frame. Preferably said auxiliary hoisting device is permanently fitted on the trolley, so as to be ready for use at any moment. For example the auxiliary hoisting device comprises one or more chain or wire hoist devices having a capacity to lower and lift the top drive device. In another embodiment the auxiliary hoisting device may comprise one or more hydraulic hoisting cylinders, possibly in a climbing mechanism.

In an embodiment the method comprises, after removal of said thrust bearing component, lowering said top drive device relative to said frame by means of said auxiliary hoisting device, e.g. to a lowermost position wherein said cooperating guide members are still engaged, e.g. fully at the lower end of the frame of the trolley.

In an embodiment the method comprises lowering said top drive device relative to said frame by means of said auxiliary hoisting device to a lowermost position wherein said cooperating guide members are still engaged, and hoisting the trolley by means of the main hoisting device such that the top drive device is disengaged from said trolley.

In an embodiment use is made of a cart, wherein the method comprises:

- after removal of the thrust bearing component from the trolley, positioning said cart underneath the top drive device,
- lowering said top drive device relative to the frame, e.g. by means of said auxiliary hoisting device fitted on the trolley, such that the top drive device is brought to rest on the cart, with the cooperating guide members are still engaged,
- hoisting the trolley by means of the main hoisting device such that the top drive device is disengaged from said trolley, moving the cart with the top drive device away, e.g. to a service and/or storage location remote from the firing line.

In practical embodiments it is envisaged that at some stage prior to bringing the top drive device to rest on the cart, the stem or quill, and/or any equipment fitted to the stem like an IBOP (inside blow out preventer), saver sub, etc. is removed. This facilitates the arrangement of the top drive device on a cart. In an embodiment the cart is provided with a tool facilitating said removal.

In an embodiment the trolley is further provided with a wrench and/or clamp device that is independently mounted on the frame of the trolley, above the thrust bearing component, e.g. the head clamp assembly carrier, and below the top drive device. This wrench and/or clamp device is adapted to retain the tool joint or box member held by the head clamp assembly when make-up or break-up of a threaded connection is performed.

In an embodiment the method comprises, after removal of the thrust bearing component, e.g. the rotational head clamp assembly carrier, removing the wrench and/or clamp device so as to clear a lowering path for the top drive device.

For example the wrench and/or clamp device is mounted on the same vertical guide member(s) of the trolley as the top drive device, with the wrench and/or clamp device being provided with cooperating vertical guide members.

In an embodiment the mentioned auxiliary hoisting device is used to lower the wrench and/or clamping device onto a cart positioned underneath after the rotatable head clamp carrier has been removed, and prior to the mentioned lowering and removal of the top drive device.

In an embodiment the one or more carts that are used in the inventive methods are each supported on one or more drill floor rails such that the cart is positionable over the well center of the drill floor. For example, as is known in the field, a pair of drill floor rails extend on opposite sides along the well center of the drill floor.

In an embodiment, as is known in the field, the drill floor is provided at the well center thereof, e.g. recessed in the drill floor or on top of the drill floor, with a slip device that is adapted to keep a drilling tubulars string suspended in a wellbore associated with said firing line.

In an embodiment the method comprises:

keeping a drilling tubulars string suspended in a wellbore associated with said firing line by means of said slip device, wherein a stick-up portion of said drilling tubulars string extends above said drill floor, positioning a cart, e.g. for transportation of the carrier and/or the wrench device and/or the top drive device, at said well center, over said stick-up portion of said drilling tubulars string so that said carrier or top drive device can be made to rest on said cart and moved away by means of said cart whilst said stick-up portion remains in place.

For example the cart is embodied like a straddling structure with a top structure embodied to support one or more of the mentioned components and with a raised straddle frame, e.g. that has a height of at least 2 meters above the drill floor.

The ability to place the cart over the well center, and as is preferred, even over a stick-up portion of the drilling string held by the slip device, allows for expedient removal of any component and/or of the top drive device.

The second aspect of the present invention also relates to a wellbore drilling installation, wherein frame of the trolley and the top drive device are provided with cooperating vertical guide members so that the top drive device is vertically displaceable and guided relative to the frame, wherein said top drive device has an operative position above said thrust bearing component, and wherein said component is releasably connected to said first and second vertical frame members allowing to remove the component, so that said top drive device can be lowered relative to said frame of said trolley until said cooperating vertical guide members thereof disengage in view of removal of the lowered and disengaged top drive device to a service and/or storage location remote from the firing line.

In embodiments the thrust bearing component comprises a rotatable head clamp assembly as described herein.

In an embodiment the installation further comprises a cart that is adapted to be positioned underneath the trolley, e.g. above the well center, said cart being adapted to rest the thrust bearing component, e.g. the rotatable head clamp assembly carrier, thereon prior to release thereof from the first and second frame members, said cart with the released component being movable to a remote location.

In an embodiment the trolley is provided with an auxiliary hoisting device adapted to vertically move at least the top drive device relative to the frame, thereby allowing to, after removal of said thrust bearing component, lowering said top drive device relative to said frame by means of said auxiliary hoisting device, e.g. to a lowermost position wherein said cooperating guide members are still engaged, e.g. onto a cart.

In an embodiment the installation further comprises a cart that is adapted to be positioned underneath the top drive device, e.g. above the well center, said cart being adapted to rest the lowered top drive device thereon with the cooperating guide members of the top drive device and the frame of the trolley still engaged, said cart with the top drive device being movable to a remote service and/or storage location.

In an embodiment the drill floor is provided with one or more drill floor rails, e.g. a pair of drill floor rails that extend on opposite sides along the well center of the drill floor, and wherein the cart is supported on said one or more drill floor rails such that the cart is positionable over the well center of the drill floor, wherein said drill floor is provided at said well center with a slip device, and wherein the cart is embodied so as to be positionable over the well center whilst the slip device keeps a drilling tubulars string suspended in a wellbore associated with said firing line with a stick-up portion of said drilling tubulars string extending above said drill floor.

In an embodiment one or more vertical displacement actuators are provided between the frame and the top drive device so that the top drive device is vertically mobile relative to the frame by said one or more vertical displacement actuators, e.g. adapted to perform controlled lowering and raising of the top drive device during make up or breaking of the threaded connection between the quill or rotary stem on the one hand and the tool joint or box member of the tubular suspended from the rotatable head clamp assembly on the other hand.

In an embodiment the top drive device and/or the trolley is provided with one or more platforms, e.g. with a railing, near the one or more top drive motors allowing for access of personnel to the top drive motors whilst the top drive device is attached to the trolley.

For example the one or more electric top drive motors are vertically arranged in the top drive device that is attached to the trolley, that is with their axis vertically.

In an embodiment a top drive device is used where the one or more top drive motors are mounted at opposed lateral sides of the top drive device, e.g. one or two motors at each lateral side of the top drive device.

For example a top drive device is used with a transmission or gearbox housing to which said one or more motors with their axis vertically are secured, e.g. by means of a bolts, e.g. through a mounting flange at one end of the motor.

In an embodiment the trolley frame has a top frame member that is suspended from one or more winch driven cables of the hoisting device. For example the top frame member carries or connects to multiple sheaves in a side-by-side arrangement.

In an embodiment, the carrier extends perpendicular to the axis of rotation of the multiple sheaves on the top frame member. This embodiment is e.g. advantageous in combination with a top drive device wherein two vertical axis electrical top drive motors are arranged underneath a gearbox or transmission housing, e.g. a left-hand motor and a right-hand motor, wherein said motors are—in vertical projection—on opposed sides of the carrier member.

The removal of a top drive device motor that is fitted underneath a gearbox or transmission housing may comprise the prior removal of the carrier and then the landing of the respective motor onto a cart.

In an embodiment the carrier or other component may comprise one or more, e.g. two parallel, girders, supporting the thrust bearing, e.g. as part of a rotatable head clamp assembly.

A rotatable head clamp assembly is provided with an open-centered body with a vertical passage there through, e.g. that allows to lower the head clamp assembly from above over the top end of a tubular in the firing line, e.g. positioned in the firing line by a racker device during drilling operations or the top end of the tubular string suspended from a drill floor mounted slip device. The rotatable head clamp assembly may be provided with a tool joint retainer assembly that is embodied to axially retain the tool joint or box member at the top of the tubular whilst the tool joint or box remains accessible for the quill or rotary stem of the top drive device.

The rotatable head clamp assembly is provided with a thrust bearing adapted to support the load of the drilling tubulars string during a drilling process, when the quill or rotary stem of top drive device is connected to the tool joint or box member of the top end of the drilling string, e.g. by a threaded connection, e.g. using a saver sub. This arrangement allows to dispense with the thrust bearing in the top drive device itself, or reduce the load on a top drive integrated thrust bearing. The rotatable head clamp assembly can thus rotatably support an entire tubular string and allow for rotary motion thereof which is imparted by the rotary stem or quill of the top drive device.

The provision of the thrust bearing component, e.g. of the rotatable head clamp assembly with thrust bearing, allows for reduced complexity and weight and dimensions of the top drive device compared to existing devices wherein the thrust bearing is very difficult to access and exchange.

In an embodiment the rotatable head clamp assembly including the thrust bearing preferably is embodied as an exchangeable unit, e.g. with a housing wherein the thrust bearing and the open-centered body of the assembly are mounted and wherein said housing is placed in a receptor of the carrier or wherein said housing is integrated with or embodied as integral part of the carrier.

The top drive device is preferably mounted within the frame of the trolley so as to be vertically mobile relative to the frame by one or more vertical displacement actuators, e.g. adapted to perform controlled lowering and raising of the top drive device during make up or breaking of the threaded connection between the quill or rotary stem on the one hand and the tool joint or box member of the tubular suspended from the rotatable head clamp on the other hand.

In an embodiment a flexible first drilling fluid hose is connected at one end to a rigid pipe piece fitted on the trolley, and a further flexible second drilling fluid hose is connected between said rigid pipe piece and the vertically mobile top drive device, e.g. to the fluid swivel thereof. It will be appreciated that the latter fluid hose can be rather short. The same arrangement can be provided for any hydraulic and/or electric lines that are to be connected to the top drive device. In this manner the vertically mobile top drive device is not subjected to the weight of the long first drilling fluid hose and other lines, which weight may be substantial if the drilling installation is e.g. embodied to handle triples or quads.

In an embodiment it is envisaged that the top drive device comprises a gearbox or transmission housing and two or more vertical axis electric motors mounted to said housing, e.g. four motors on top of said housing. In another example two motors are provided, e.g. one motor at each lateral side of the top drive device. For example the one or more vertical axis electric motors are arranged underneath the gearbox or transmission housing, e.g. each on a lateral side of the top drive device, with the rotary stem or quill extending downward from the gearbox or transmission housing in a space between said downward depending top drive motors. This arrangement may allow for a reduction of the height of the top drive device.

In an embodiment the trolley frame comprises an elongated top frame member supporting multiple cable sheaves in side by side arrangement, e.g. so that their sheaves revolve about a common horizontal axis intersecting the firing line, and a single vertical rear frame member depending from said top frame member. Further parts of the trolley that carry rail engaging wheels or the like are then connected, e.g. permanently as a welded structure, to said rear frame member.

The present invention also relates to a combination a wellbore drilling trolley and a top drive device, said combination being adapted to perform drilling activities using a drilling tubulars string in a firing line associated with a wellbore, which combination comprises:

- a trolley, said trolley being adapted to be guided along at least one vertical trolley rail,
- a top drive device attached to the trolley, said top drive device comprising:
  - one or more top drive motors,
  - a rotary stem or quill driven by said one or more motors in order to impart rotary motion to a drilling tubulars string when connected to said top drive device, wherein the trolley comprises a frame with:

- a horizontal top frame member, e.g. extending in a transverse direction of said trolley, which top frame member may be provided with multiple cable sheaves and/or with multiple cable sheave connectors that are each connectable to a cable sheave allowing to suspend the frame from one or more winch driven cables of a main hoisting device,
- a first and a second vertical frame member, each connected at an upper end thereof directly to said horizontal top frame member, said first and second vertical frame members depending from said top frame member spaced apart from one another and being adapted to support the load of a drilling tubulars string,
- a thrust bearing component releasably connected to and suspended from said first and second vertical frame members of the trolley, said thrust bearing component being provided with a thrust bearing that is adapted to support the load of a drilling tubulars string, so that said load is transmitted via said thrust bearing component to said first and second vertical frame members and thereby to said top frame member suspended from said main hoisting device, wherein frame and the top drive device are provided with cooperating vertical guide members so that the top drive device is vertically displaceable and guided relative to the frame, wherein said top drive device has an operative position above said thrust bearing component, wherein said thrust bearing component is releasably connected to the first and second vertical frame members.

In an embodiment the cooperating vertical guide members are adapted to provide a lower transfer position of said top drive device relative to said frame generally at the height of said lower ends of said first and second vertical frame members, e.g. allowing for easy transfer/landing onto a cart.

In an embodiment the frame comprises one or more vertical guide members, e.g. rails, that are common to said top drive device and at least said thrust bearing component, e.g. the rotatable head clamp assembly carrier, e.g. a pair of parallel vertical rails with each of said top drive device and said thrust bearing component being provided with cooperating guide members, e.g. rollers or sliders, that cooperate with said one or more common vertical guide members.

In an embodiment the frame comprises a single rear frame member embodied as a vertical box girder provided with one or more vertical rails, e.g. a pair of vertical rails.

In an embodiment the trolley is provided with an auxiliary hoisting device adapted to move at least said top drive device between a lower exchange or transfer position and an operative position, e.g. also said thrust bearing component, e.g. said rotatable head clamp assembly carrier with said head clamp assembly, e.g. also said wrench and/or clamp device.

In an embodiment the first and second vertical frame members are embodied as left-hand and right-hand frame members that are connected to the top frame member at spaced apart locations in a transverse direction of the frame, preferably in a transverse plane encompassing said firing line.

In an embodiment the first and second vertical frame members are embodied as pivotal link members, each having an upper eye pivotally connected to said top frame member.

In an embodiment each first and second pivotal link member has a lower eye pivotally connected to said carrier, e.g. said carrier having a hook adapted to be fitted into a corresponding eye at a lower end of said pivotal link member. For example the carrier is a forged steel component provided with hooks that each fit into a corresponding lower eye of a first and second frame member.

In an embodiment said first and second vertical frame members are one piece forged steel frame members. In another embodiment these frame members are made out of steel plate.

In an embodiment each of said first and second vertical frame members has a load rating of at least 500 tons.

In an embodiment the frame has a rear frame member, e.g. a single rear frame member forming a sort of a spine of the frame, that is arranged rearward from said firing line, and that is provided with one or more vertical guide rails for said top drive device and possibly also for one or more of the carrier and a wrench and/or clamp device.

In an embodiment the top drive device has four motors above a gearbox, wherein a first pair of motors is arranged, when seen in top view, in front of said horizontal top frame member and wherein a second pair of said motors is arranged rearward of said horizontal top frame member, e.g. in an operative position of the top drive device said horizontal top frame member at least in part being located in a gap between said first and second pair of motors.

In an embodiment the top drive device has multiple motors, e.g. four motors, preferably with at least one motor having an operable clutch device allowing to disconnect upon command the rotor of said motor from the quill or stem and thereby from any drill string connected thereto, whereas one or more of the other motors remain connected to the drill string for driving said drill string.

In an embodiment the thrust bearing component comprises:

a rotatable head clamp assembly carrier, that is connected to lower end of said first and second vertical frame members and retained at a spacing below the horizontal top frame member by said first and second vertical frame members, a rotatable head clamp assembly that is supported by, e.g. integrated with, said rotatable head clamp assembly carrier, which rotatable head clamp assembly is provided with an open-centered body with a vertical passage there through that allows to lower the head clamp assembly from above over a top end of a drilling tubular in a firing line, wherein the rotatable head clamp assembly is provided with a tool joint retainer assembly that is embodied to axially retain a tool joint or box member at the top of said drilling tubular whilst the tool joint or box remains accessible for the quill or rotary stem of the top drive device, wherein the rotatable head clamp assembly is provided with a thrust bearing adapted to support the load of the drilling tubulars string during a drilling process, when the quill or rotary stem of top drive device is connected to the tool joint or box member of the top end of the drilling string, e.g. by a threaded connection.

The present invention also relates to a trolley for use in a wellbore drilling installation, said trolley being adapted to support a top drive device, wherein the frame of the trolley has a rigid frame structure formed by one or more rear frame members, one or more forward cantilevered frame members extending forward from a top end of said one or more rear frame members, and by a transverse horizontal top frame member supported by said one or more forward cantilevered frame members at a distance forward of said one or more rear frame members. First and second link members are suspended from said transverse horizontal top frame member, said first and second link members being suspended in a transverse plane that encompasses the firing line. A thrust bearing component, e.g. a rotatable head clamp assembly carrier, is connected, preferably releasably, to lower ends of said first and second link members.

In an embodiment said first and second link members are embodied as left-hand and right-hand link members, with the thrust bearing component or other component being connected, e.g. hooked, to lower ends of said link members.

The present invention also relates to the combination of a trolley for use in a wellbore drilling installation and a top drive device, wherein the frame of the trolley has a rigid frame structure formed by one or more rear frame members, one or more forward cantilevered frame members extending forward from a top end of said one or more rear frame members, and by a transverse horizontal top frame member supported by said one or more forward cantilevered frame members at a distance forward of said one or more rear frame members, and wherein the top drive device has four motors above a gearbox, wherein a first pair of motors is arranged, when seen in top view, in front of said horizontal transverse top frame member and wherein a second pair of said motors is arranged rearward of said horizontal transverse top frame member, e.g. in an operative position of the top drive device said horizontal top frame member at least in part being located in a transverse gap between said first and second pair of motors, and e.g. wherein said one or more forward cantilevered frame members are at least in part located in a gap between said motors of said second pair.

The present invention also relates to a method for removing a top drive device from a wellbore drilling installation which comprises:

a drilling tower, a drill floor having a well center through which a drilling tubulars string can pass along a firing line into the wellbore, at least one vertical trolley rail, a trolley, said trolley being guided along at least one vertical trolley rail, a main hoisting device adapted to lift and lower said trolley along said at least one vertical trolley rail, e.g. said main hoisting device comprising one or more winch driven cables from which said trolley is suspended, a top drive device attached to the trolley, said top drive device comprising:

one or more top drive motors, a rotary stem or quill extending in said firing line and being driven by said one or more motors in order to impart rotary motion to a drilling tubulars string when connected to said top drive device, wherein the trolley comprises a frame that is suspended from said main hoisting device, said frame having a rotatable head clamp assembly carrier below said top drive device, said carrier supporting a rotatable head clamp assembly, wherein the frame is adapted to absorb the load of a drilling tubulars string suspended from the rotatable head clamp assembly, wherein a rotatable head clamp assembly is provided with an open-centered body with a vertical passage there through that allows to lower the head clamp assembly from above over a top end of a drilling tubular in said firing line, wherein the rotatable head clamp assembly is provided with a tool joint retainer assembly that is embodied to axially retain a tool joint or box member at the top of said drilling tubular whilst the tool joint or box remains accessible for the quill or rotary stem of the top drive device, wherein the rotatable head clamp assembly is provided with a thrust bearing adapted to support the load of the drilling tubulars string during a drilling process, when the quill or rotary stem of top drive device is connected to the tool joint or box member of the top end of the drilling string, e.g. by a threaded connection, wherein, e.g. in order to service and/or exchange of the top drive device, the method comprises:

removing the rotatable head clamp assembly carrier from underneath the top drive device, placing a cart underneath the top drive device, lowering said top drive device relative to the frame and bringing said top drive device to rest on the cart and disengaging the top drive device from the frame, moving said lowered and disengaged top drive device by means of said cart to a service and/or storage location remote from the firing line.

The present invention also relates to a drilling installation comprising:

a drilling tower, a drill floor having a well center through which a drilling tubulars string can pass along a firing line into the wellbore, at least one vertical trolley rail, a trolley, said trolley being guided along at least one vertical trolley rail, a main hoisting device adapted to lift and lower said trolley along said at least one vertical trolley rail, e.g. said main hoisting device comprising one or more winch driven cables from which said trolley is suspended, a top drive device attached to the trolley, said top drive device comprising one or more top drive motors, wherein the trolley comprises a frame that is suspended from said main hoisting device, wherein the installation comprises one or more components to be suspended from the trolley frame below the top drive device, wherein the installation further comprises one or more carts that are movable onto the drill floor underneath the trolley and are adapted to receive thereon the top drive device or a component of said one or more components, wherein at least one of said carts is embodied with a straddling structure having a top structure embodied to support one or more of said components and with a raised straddle frame, e.g. that has a height of at least 2 meters above the drill floor when the cart is positioned on the drill floor underneath the trolley.

This for example allows to place the cart over the well center, and as is preferred, over a stick-up portion of a drilling string held by a slip device.

It will be appreciated that features discussed herein with reference to one aspect of the invention are also combinable with one or more of the other aspects of the invention, e.g. as evidenced by the drawings and the description thereof.

The present invention also relates to well drilling installations, combinations, top drive devices, and/or methods, etc. as described herein, e.g. in the appended claims.

Figure 2:
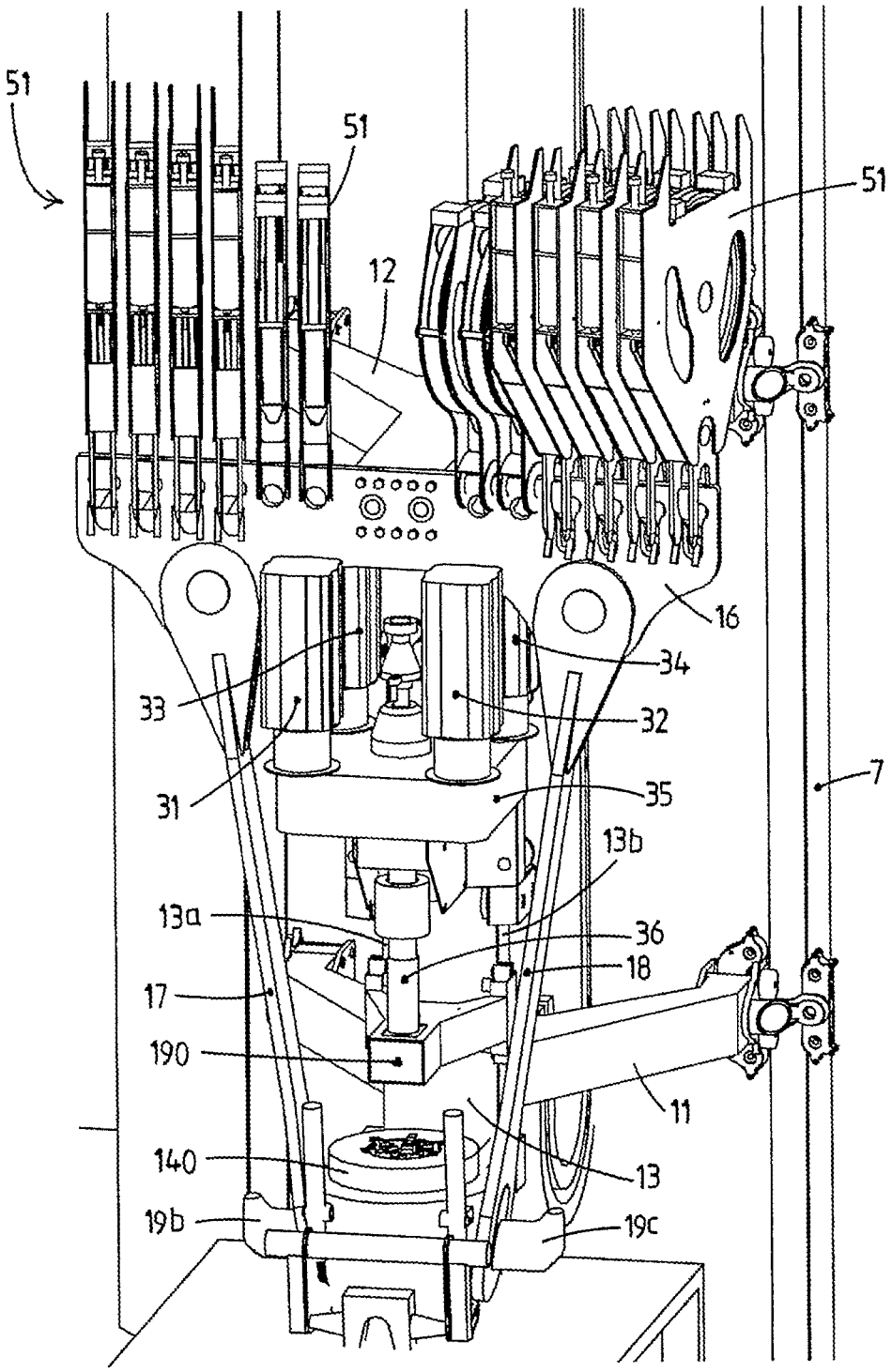
Figure 3:
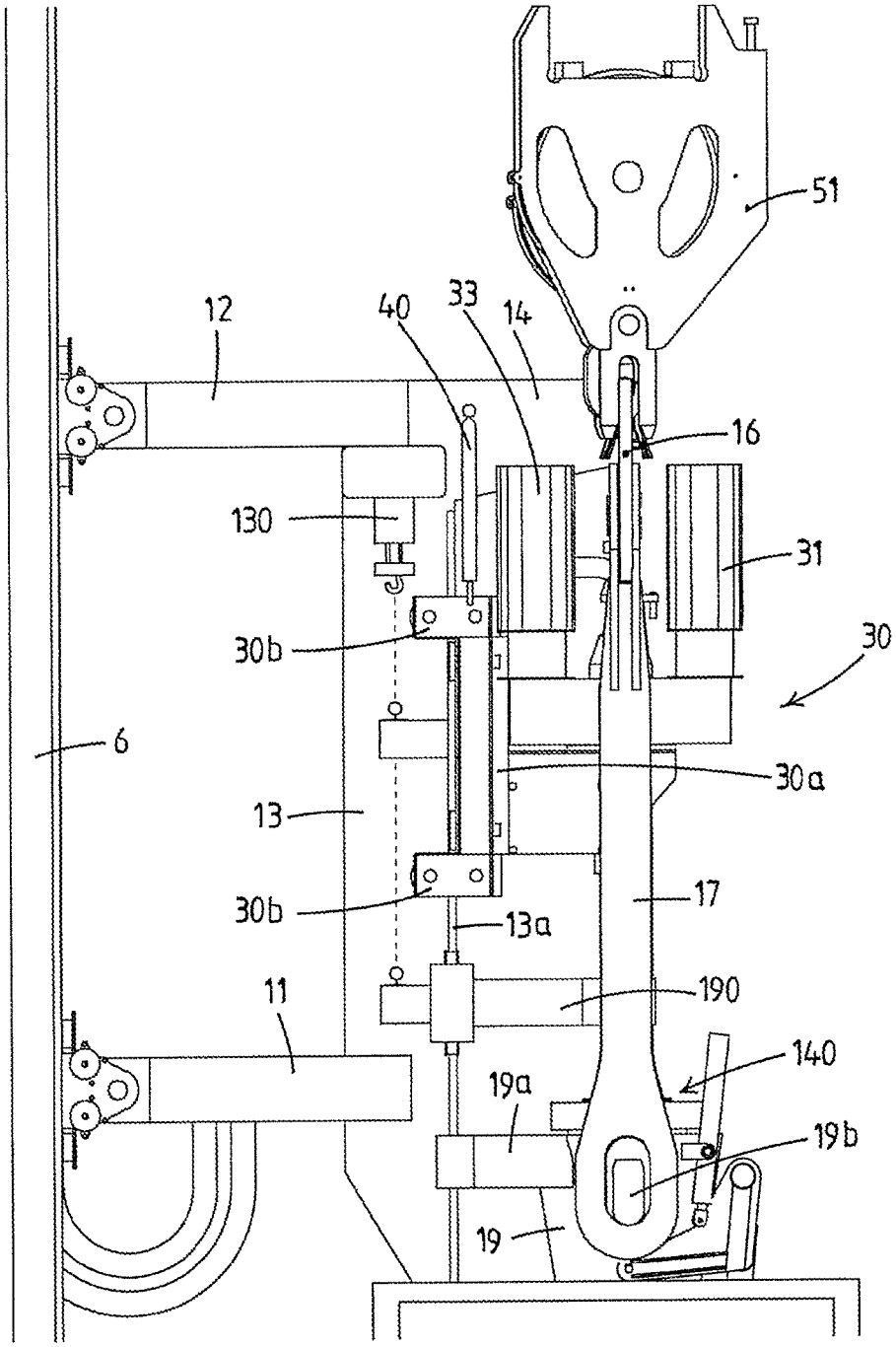
Figure 4:
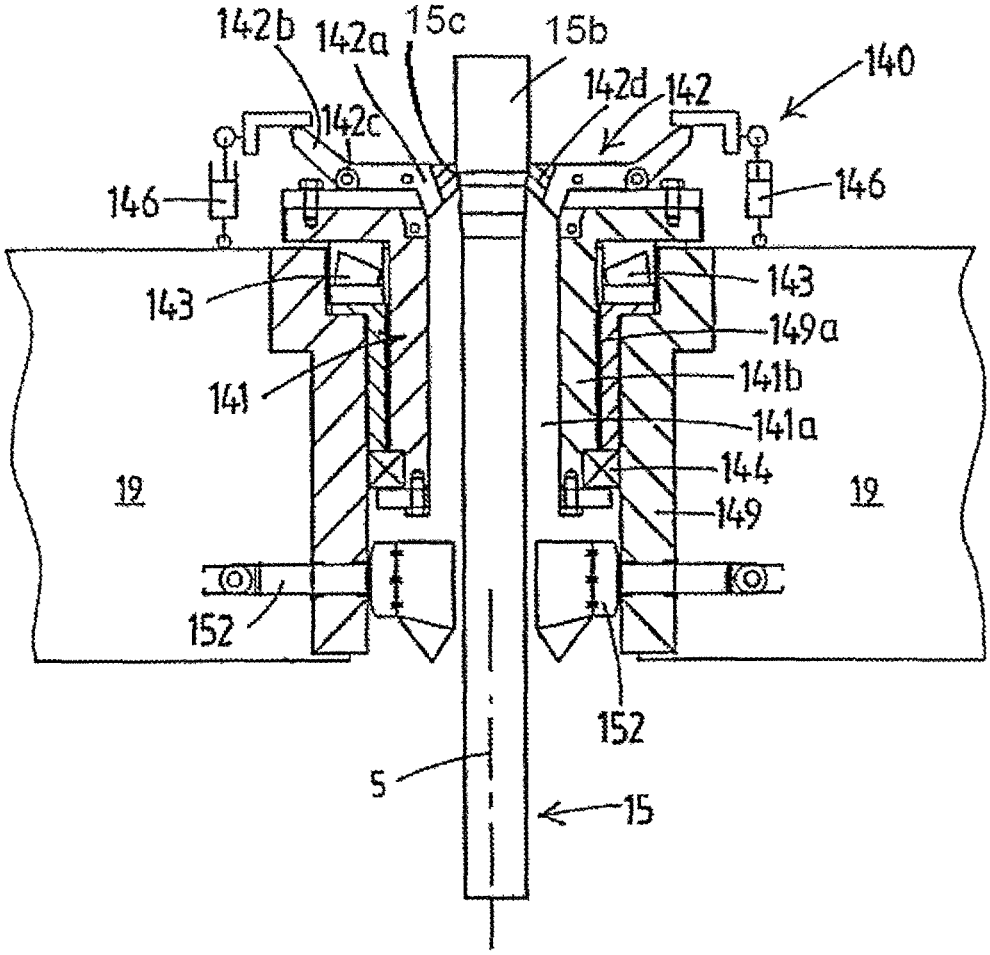
Figure 17:
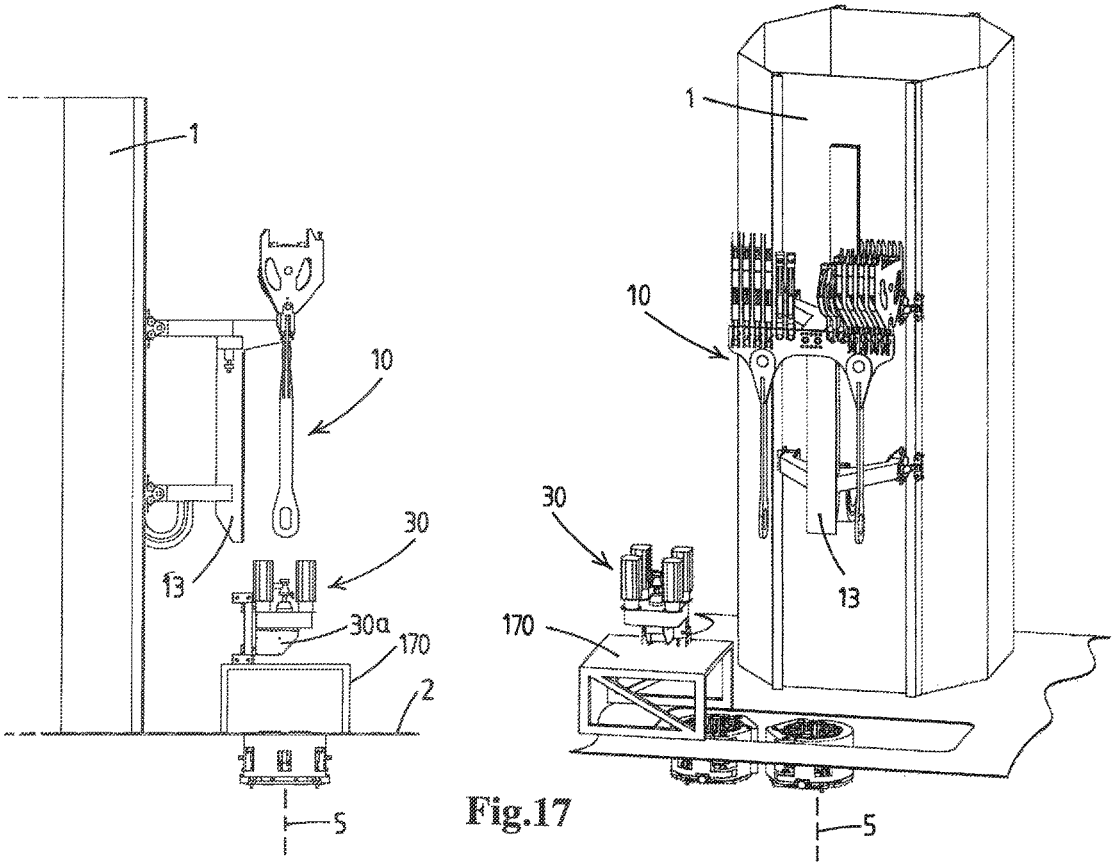
Figure 18:
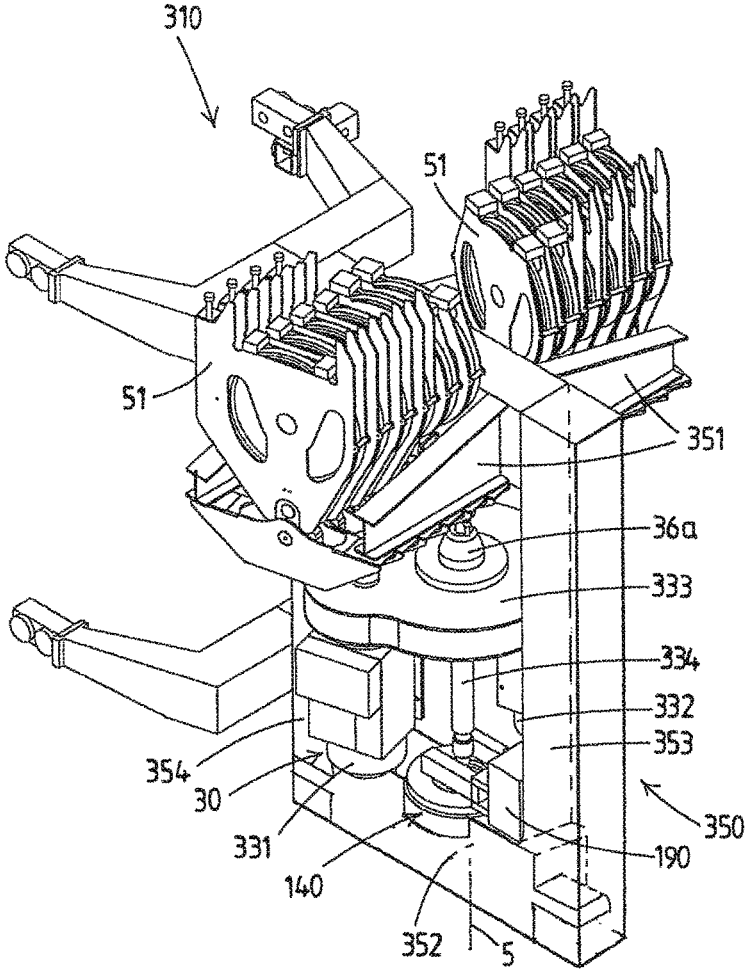
Figure 19:
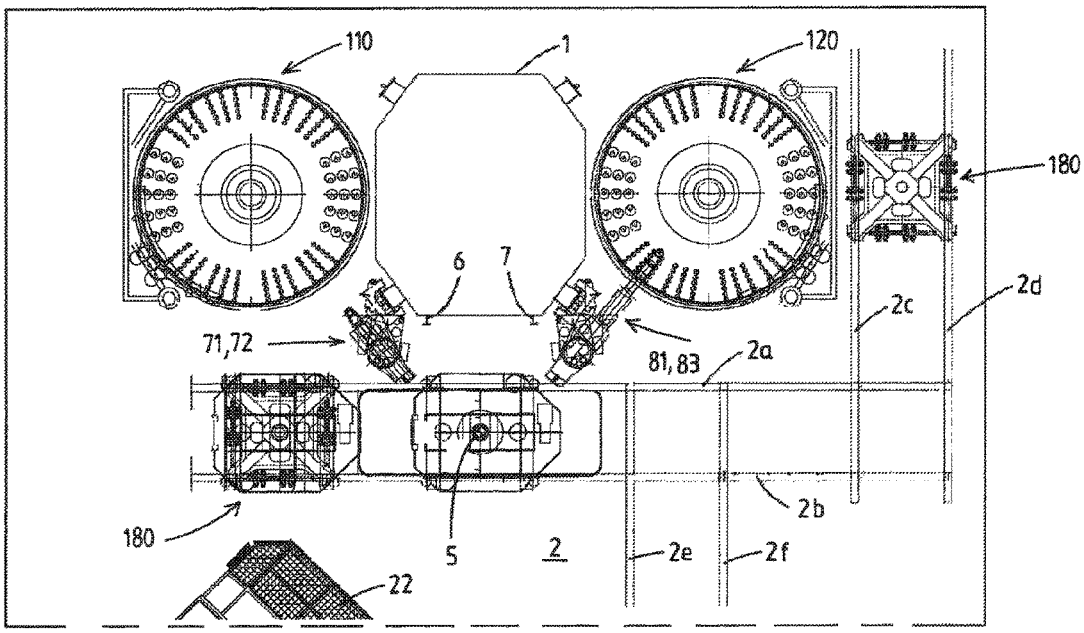
Figure 20:
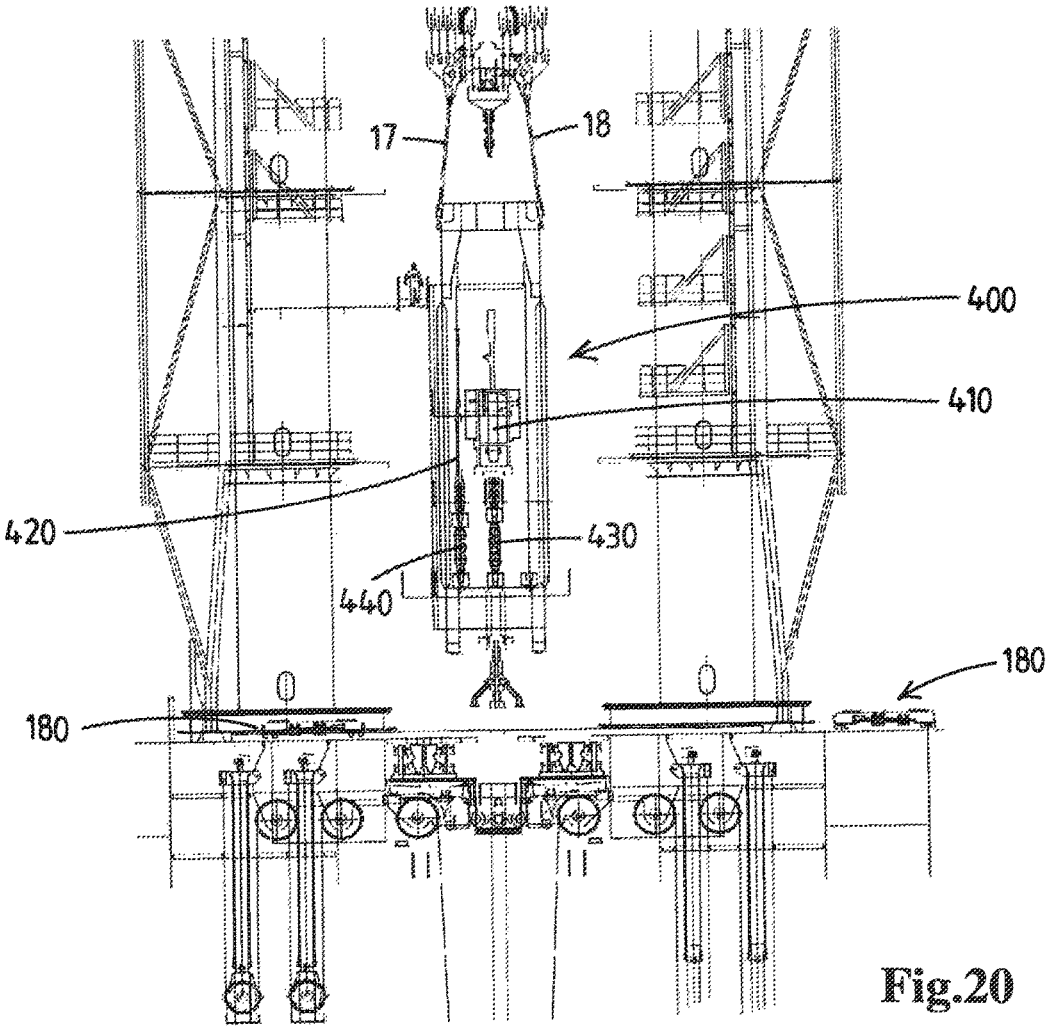
Figure 21:
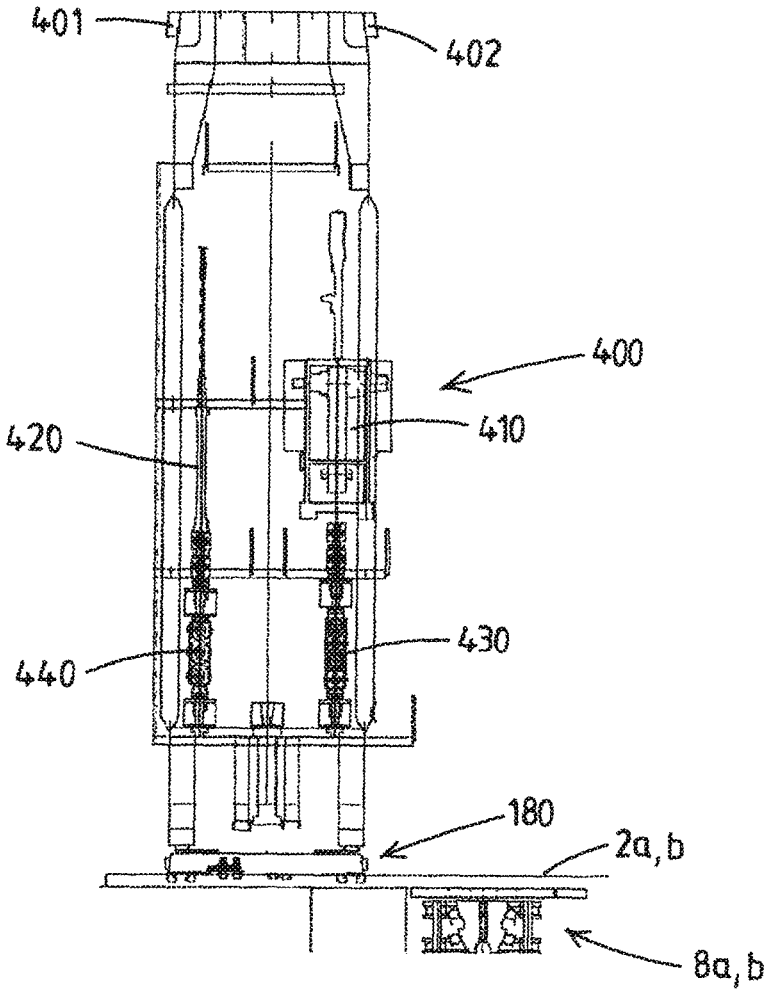
Figure 22:
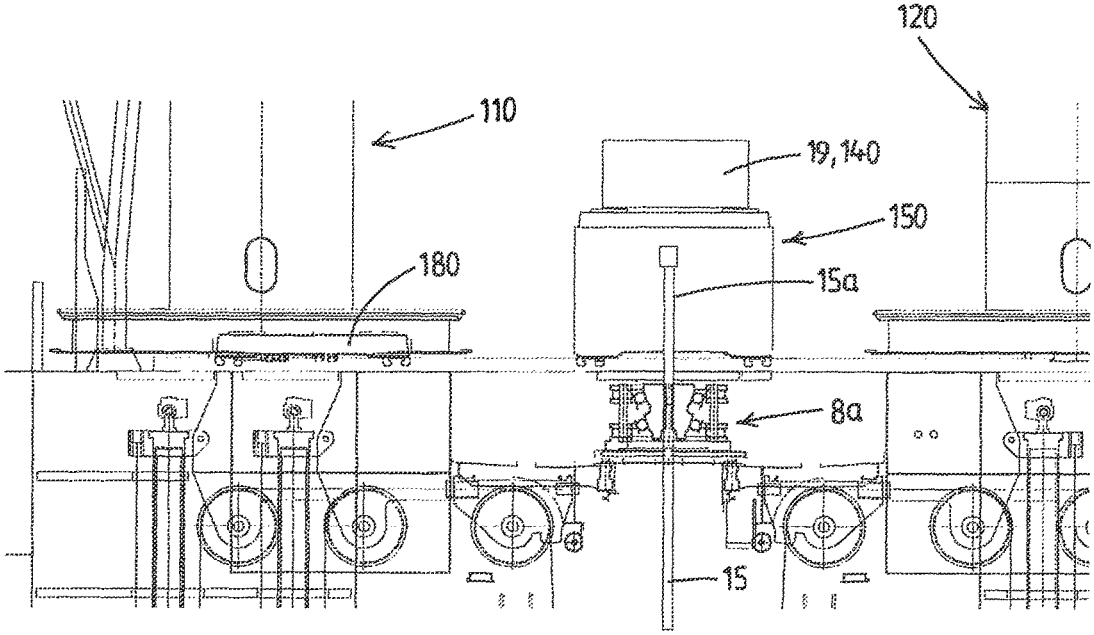

The invention will now be described with reference to the appended drawings. In the drawings:

FIG. 1 shows a wellbore drilling installation according to the invention,

FIG. 2 shows in side view the trolley and top drive device of the installation of FIG. 1, FIG. 3 shows in view from the rear the trolley and top drive device of the installation of FIG. 1, FIG. 4 illustrates an example of the rotatable head clamp assembly of the installation of FIG. 1, FIGS. 5*a-c* further illustrate the rotatable head clamp assembly of FIG. 4, FIGS. 6-17 illustrate in a step by step manner the removal of components from the trolley of the installation of FIG. 1, FIG. 18 illustrates an alternative embodiment of the trolley with top drive device, carrier, and wrench device, FIG. 19 illustrates in plan view an example of an wellbore drilling installation according to the invention, FIG. 20 illustrates in vertical sectional view a well intervention structural frame component suspended from the trolley along the drilling tower above the well center in the drill floor, FIG. 21 illustrates the well intervention structural frame component of FIG. 20, FIG. 22 illustrates a lower height cart as well as a raised straddle frame cart positioned over a stick-up end of a tubular retained by the slip device above the drill floor in the well center.

FIG. 1 shows a wellbore drilling installation with a trolley, top drive device, and rotatable head clamp and carrier according to the invention. It is envisaged that the depicted installation is part of an offshore drilling vessel for performing offshore drilling and/or other wellbore related activities, e.g. well intervention. It will be appreciated that, when desired, the invention is also applicable to land based drilling installations.

The installation comprises a drilling tower 1 that is here embodied as a mast with a closed contoured steel structure with at least one firing line 5 outside of the mast itself. For example the mast is arranged adjacent a moonpool of a drilling vessel, or over a larger moonpool with two firing lines along opposed outer faces of the mast 1 as is known in the art.

In an alternative design the drilling tower is embodied as a derrick with the firing line within the structure of derrick, e.g. the derrick having a lattice structure placed over the moonpool.

FIG. 1 shows a drill floor 2 having a well center 3, e.g. with a slip device 8*a,b* (here two devices that can travel over associated track into and out of the firing line) arranged at said location, through which a drilling tubulars string 4 can pass along a firing line 5.

The mast 1 is at the side of the drill floor 2 provided with two parallel vertical trolley rails 6, 7. A trolley 10 is guided along the trolley rails 6, 7.

A top drive device 30 is attached to the trolley 10.

The top drive device 30 comprises in this example four electric top drive motors 31, 32, 33, 34 which commonly drive, via gearbox or transmission housing 35, a rotary stem or quill 36. As known in the art the quill 36 is connectable, e.g. via a threaded connection, e.g. via a saver sub, to the top end of a drilling tubular aligned with the firing line. Thereby the top drive device 30 is able to impart rotary motion and drive torque to a drilling tubulars string.

A main hoisting device 50 is provided that is adapted to move the trolley with the top drive device up and down along the vertical trolley rails 6,7.

For example the frame of the trolley and hoisting device 50 have sufficient strength and capacity to handle a load of 1000 tons or more in the firing line.

A left-hand motion arm rail 60 and a right-hand motion arm rail 61 are present on opposed lateral sides of a vertical path of travel of the trolley 10 with the top drive device 30 along said the vertical trolley rails 6,7.

On each of said motion arm rails 60, 61 at least one, here three as is preferred, motion arm assembly 70, 71, 72, 80, 81, 82 is arranged. Each assembly is, as preferred independently controlled from any other assembly on the same rail 60, 61, vertically mobile along the respective rail by a respective motion arm assembly vertical drive.

As depicted there are two tubulars storage racks 110, 120, each along a respective side of the mast 10. These racks 110, 120 are each adapted to store multi-joint tubulars, here triples 9 (about 36 meter), therein in vertical orientation.

It is illustrated that two of the motion arm assemblies 71, 72, 81, 82 on each vertical rail 60, 61 are equipped with a tubular gripper. The height of the rails 60, 62 is at least such that the upper assembly 72, 82 can be arranged to grip the tubular in the storage rack 110, 120 at an appropriately high location.

The motion arm assemblies with grippers can be operated in unison to act as part of the tubular racker device allowing to transfer drilling tubulars stands, e.g. drill pipe or casing pipe or other drilling tubulars between the firing line 5 and the respective storage rack 110, 120.

As can be seen in FIGS. 1-3 the trolley 10 has a rigid frame structure with upper and lower trolley beams 11, 12 that each have at each end thereof rollers engaging the respective trolley rail 6, 7 on the mast 1. These beams 11, 12 here have about a V-shape in top view.

These beams 11, 12 support here a single vertical rear frame member 13, that embodies sort of a spine of the trolley 10 and that spans the height between the beams 11, 12.

This rear frame member 13 is provided with one or more, here a pair of parallel, vertical guide rails 13*a, b*. The top drive device 30 is provided with a chassis 30*a* with rollers 30*b* or other guide members that cooperate with said guide rails 13*a, b*.

This rear frame member 13 may be embodied as a box girder.

From the top end of said rear frame member 13 a forward cantilevered frame member 14 extends, away from the mast 1. At its forward end this frame member 14 carries a transverse horizontal top frame member 16, generally in a transverse imaginary plane that encompasses the firing line 5.

The top frame member 16 is provided with connectors, here holes, for connecting thereto a series of cable sheaves 51 in a side by side arrangement. The mast 1, as a crown block, is also provided with cable sheaves 52 so that the trolley 10 is suspended by one or more winch driven cables in a multiple fall arrangement.

The trolley frame further comprises first and second frame or link members 17, 18 which are suspended from the transverse horizontal top frame member in a transverse plane that encompasses the firing line. As depicted these members 17, 18 are directly and pivotally connected to the frame member 16, here pivotal about an axis perpendicular to said transverse plane. As is preferred each member 17, 18 has an upper eye, as here through two spaced apart tabs, with a pin being secured through said eye and through a hole in the frame member 16.

The frame of the trolley further comprises a rotatable head clamp assembly carrier 19, which is connected, as is preferred releasably, to lower ends of said first and second members 17, 18.

As discussed the vertical guide rails 13*a,b* guide the top drive device 30 as the rollers 30*b* of the chassis 30*a* ride along said rails 13*a, b*.

In this embodiment, as preferred, the same guide rails 13*a,b* also guide the carrier 19, here a guidance portion 19*a* thereof. Also, as preferred, the same guide rails 13*a, b* guide the wrench and/or clamping device 190, which will be discussed later.

In addition to guiding said components, the one or more guide rails 13*a, b* here, as is preferred, also serve the purpose of absorbing any reaction torque that is caused by operation of the installation on the respective component and transmit said torque to the frame of the trolley 10.

Between the top drive device 30 and the trolley frame there are one or more vertical displacement actuators 40 so that the top drive device 30 is vertically mobile relative to the frame by said one or more vertical displacement actuators, here adapted to perform controlled lowering and raising of the top drive device during make up or breaking of the threaded connection between the quill or rotary stem on the one hand and the tool joint or box member of the tubular suspended from the rotatable head clamp assembly on the other hand.

The trolley is provided with an auxiliary hoisting device 130 that is adapted to vertically move at least the top drive device 30, here also the device 190, relative to the frame. It is depicted that the device 130 includes a chain hoist device, with a hook that can be coupled to either the top drive chassis 30*a* or the device 190 as shown in FIG. 3.

Reference numeral 190 indicates a wrench and/or clamp device that allows to retain the tool joint or box member held by the assembly 160 when make-up or break-up of a threaded connection is performed.

The carrier 19 supports, here is integrated with, a rotatable head clamp assembly 140 of which an example is depicted in FIGS. 4, 5*a-c*. For example the rotatable head clamp assembly 140 is designed to handle a firing line load of at least 1000 tons.

With reference to FIGS. 4, 5*a-c*, an embodiment of the rotatable head clamp 140 will be discussed.

The head clamp 140 here comprises:

- a rotary open-centered body 141 defining a vertical passage 141*a* in line with a firing line A to allow passage of a pipe of the drill string, e.g. a special sub fitted to the top end of the drill string;
- a thrust bearing 143 supporting the rotary body 141, allowing rotation thereof under the full load of the drilling tubulars string hanging in the wellbore;
- multiple mobile retainers 142 supported by the rotary body 141 so as to provide an operative and a non-operative mode of the rotatable head clamp.

In the shown embodiment, the rotatable head clamp comprises a housing 149 supporting the thrust bearing 143, which housing is supported by the carrier 19. Alternatively, the carrier 19 support the head clamp 140 directly via the thrust bearing 143. Either way, the carrier 19 absorbs the load of the suspended drill string.

Here, the rotary body is embodied as a cylinder 141*b* with a flanged top end 141*a* supporting the mobile retainers 142. The thrust bearing 143 supports the flanged top end 41*a* of the rotary body.

Furthermore, in the shown embodiment, an additional radial load bearing 144 is provided at the bottom end of the rotary body 141. A bearing connection 149*a* , which is a static frame part optionally integrated with housing 149, connects the thrust bearing 143 at the upper side of the rotary open-centered body with bearing 144 at the bottom end thereof.

In the shown embodiment, the carrier 19 furthermore supports a centralizer 152 below the head clamp 140 to centralize the drill string. Such centralizers are known in the art.

Retainers 142 are movable between a non-operative position and an operative position. In the non-operative position (not shown) the retainers 142 allow passage of a pipe of the drill string, e.g. a special sub fitted to the drill string, through the pipe passage 141*a*. In the operative position as shown in FIG. 4, the retainers 142 engage below a shoulder 15*c* of the tool joint or box portion 15*b* of a pipe, e.g. special sub, extending through the passage 141*a* so as to suspend said drill string therefrom.

In the shown embodiment, the mobile retainers 142 each have a jaw 142*a* to engage on a pipe, which is preferably an exchangeable jaw, e.g. to be able to match the diameter and/or shape to the type of pipe.

Figure 5C:
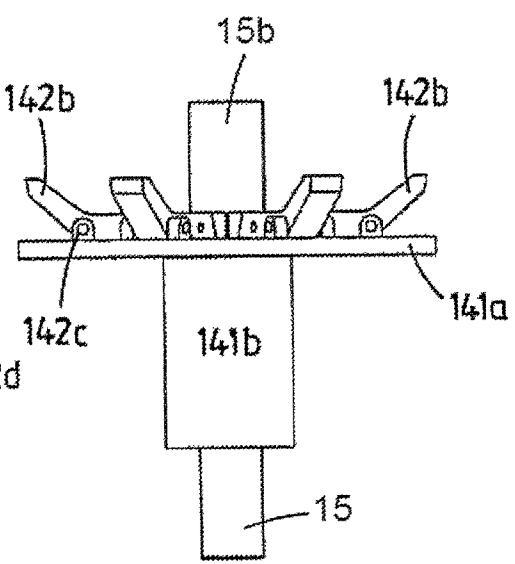
Figure 5B:
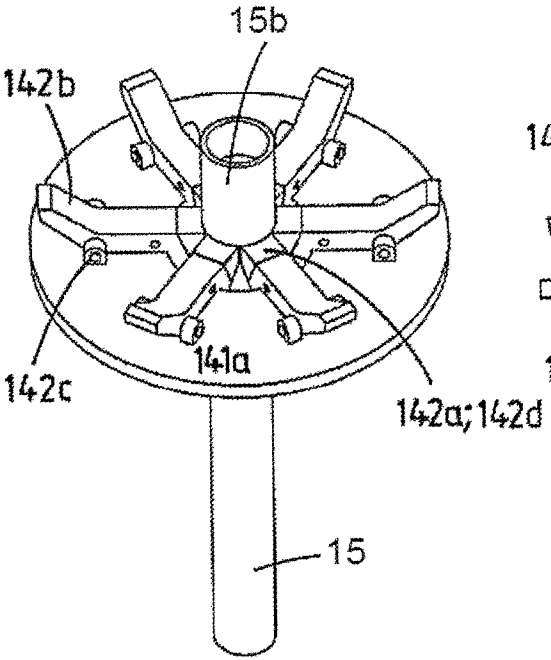
Figure 5A:
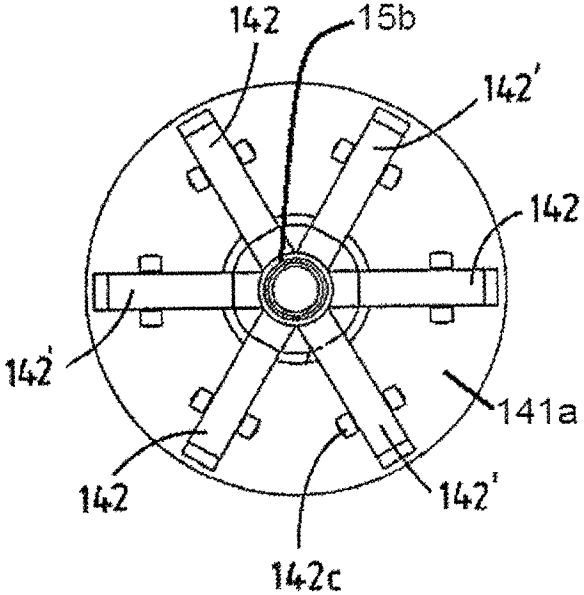

In FIGS. 5*a-c* a possible embodiment of a head clamp is shown in top view, a perspective top view and a side view. This head clamp is provided with two sets each three mobile retainers 142 and 142' respectively. Each set is adapted to retain a different type of pipe. This is advantageous as it is possible to have one set in the non-operative position and the other in the operative position.

The mobile retainers 142, 142' of FIG. 4 and FIG. 5 are embodied as a lever comprising an arm and a fulcrum, which fulcrum 142*c* is fixed to the rotary body, here flange 141*a*. One end 142*a* of the arm is adapted to—in the operative position—engage on the pipe. Here, this end 142*a* of the arm is provided with clamping jaws 142*d*. In the non-operative position has cleared the area in line with the pipe passage to allow the passage of a pipe of the drill string. The other end 142*b* of the arm is operable by an actuator 146 to move the opposite end of the arm between the operative and the non-operative position. Here, the actuator 146 is embodied as a hydraulically operable finger engaging on the arm end 142*b*.

Figure 6:
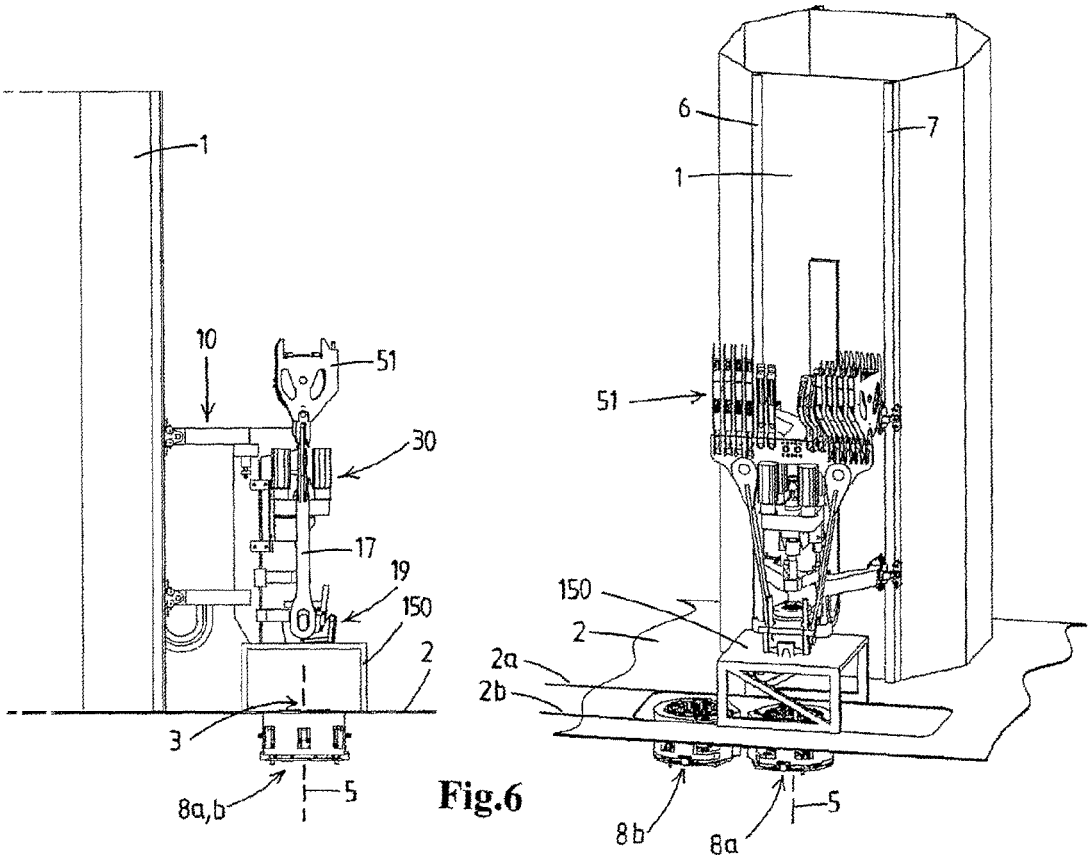

In FIG. 6 a part of the installation of FIG. 1 is depicted.

The drill floor is denoted with 2. Recessed in the drill floor provision is made for two slip devices 8*a, b* that can be selectively aligned with the well center 3 through which the firing line extends.

Along opposed sides of the slip device there is a pair of floor rails 2*a*, 2*b* on the drill floor over which a cart 150 can be moved into position over the well center 3.

As can be seen the cart 150, and possibly also other carts that are to be positioned over the well center in this invention, has a straddling structure with a top structure 151 embodied to support one or more of the mentioned components, here the carrier 19 with the rotatable head clamp 140, and with a raised straddle frame, e.g. that has a height of at least 2 meters above the drill floor 2.

In FIG. 22 it is depicted schematically that the cart 150 with raised straddle frame has a top structure that supports component 19 with head clamp assembly 140. It is illustrated that the slip device 8*a* supports a drilling tubular 15 so that a so-called stick-up end portion 15*a* thereof extends above the drill floor, e.g. over a height of at least 1 meter. The cart 150 is high enough to be arranged in the well center, over this stick-up portion.

To the left thereof FIG. 22 depicts a low version of a cart 180, that can e.g. be used to transport tall components, like the well intervention structural frame component 400 that will be described in more detail with reference to FIGS. 20, 21.

FIG. 6 depicts that the trolley 10 has been lowered so that the carrier 19 with head clamp 140 is brought to rest on the cart 150.

Figure 7:
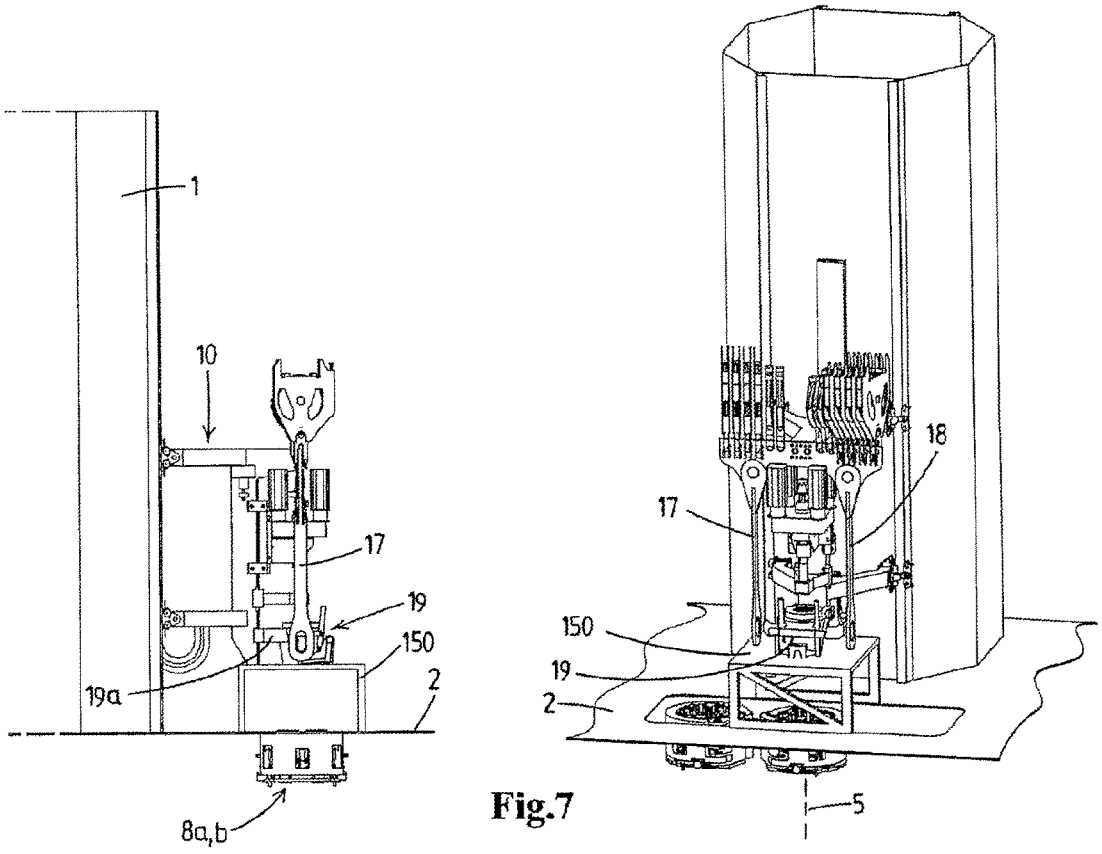

FIG. 7 depicts that the first and second link members 17, 18 are released from the carrier 19 resting on the cart 150. This is easily done here as the link members 17, 18 are pivotal outwards so as to disengage hook portions 19*b, c* of the carrier 19 from the respective lower eye or aperture of the link member 17,18.

In FIG. 7, as preferred, it can be seen that the carrier 19 has a guidance portion 19*c* that is engaged with the guide rails 13*a, b* on the trolley frame, e.g. to absorb any reaction torque and or to keep the head clamp 140 aligned with the firing line 5.

Figure 8:
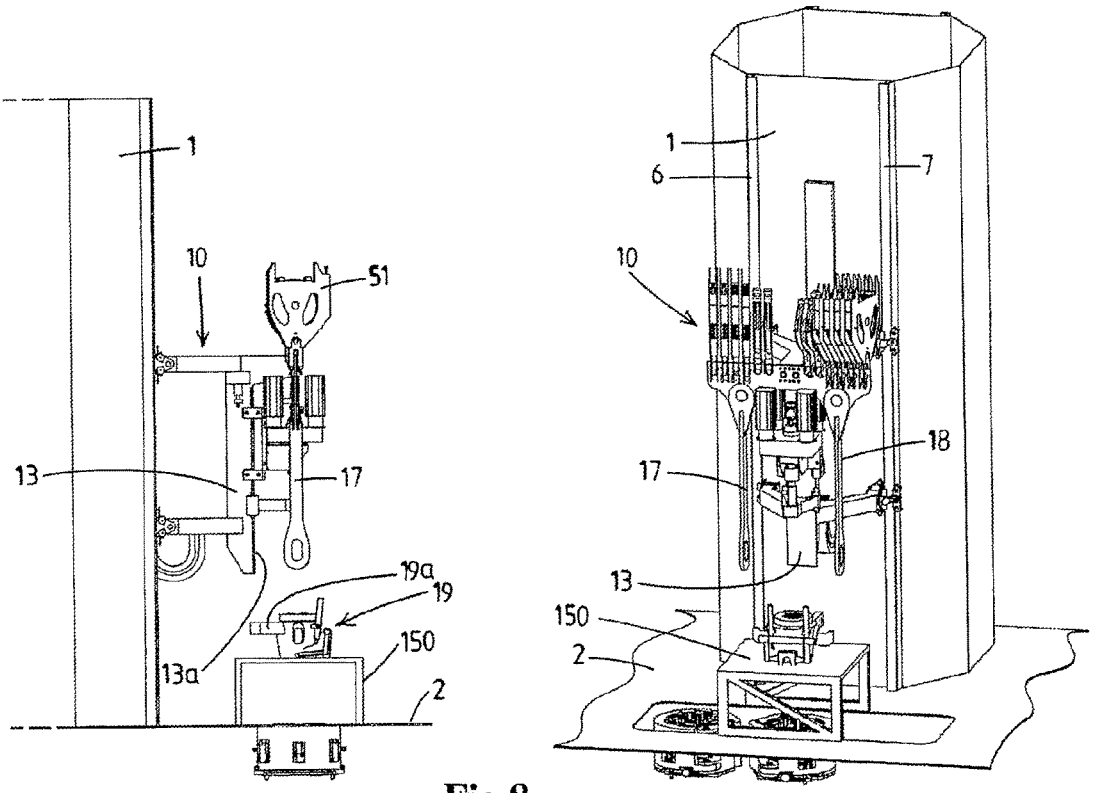

In FIG. 8 it is depicted that the trolley 10 is hoisted, so that the carrier guidance portion 19*a* slides from the guide rails 13*a, b* of the trolley frame.

Figure 9:
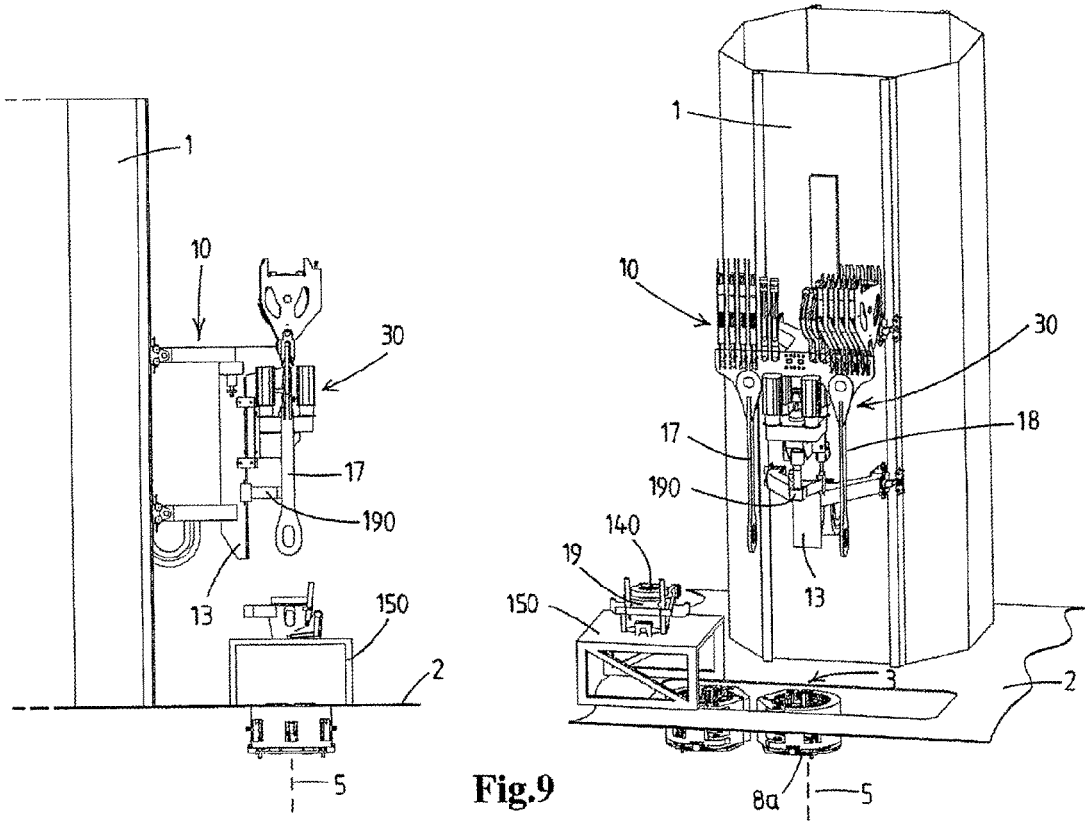

FIG. 9 depicts that the cart 150 with the carrier 19 and head clamp 140 resting thereon is moved away from the well center 3.

Now the wrench and/or clamp device 190 has to be removed, as it is independently mounted to the frame below the top drive unit 30.

Figure 10:
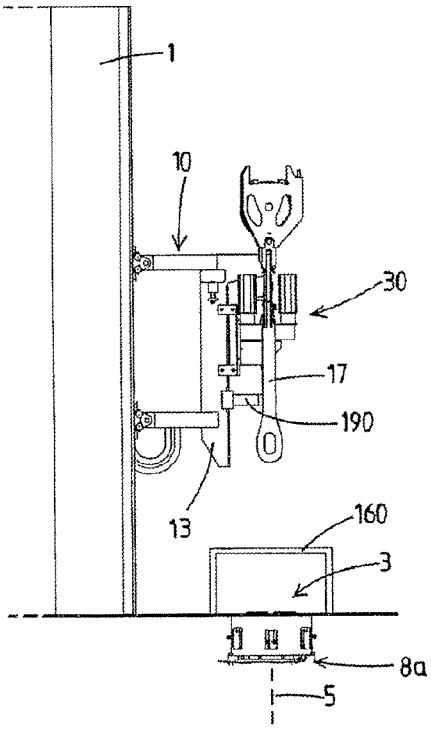
Figure 10:
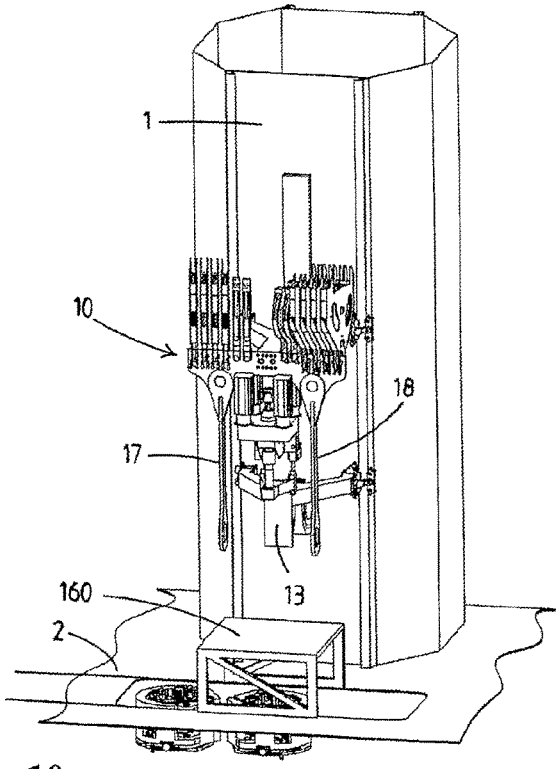

FIG. 10 depicts that a cart 160 is brought into position over the well center 3.

Figure 11:
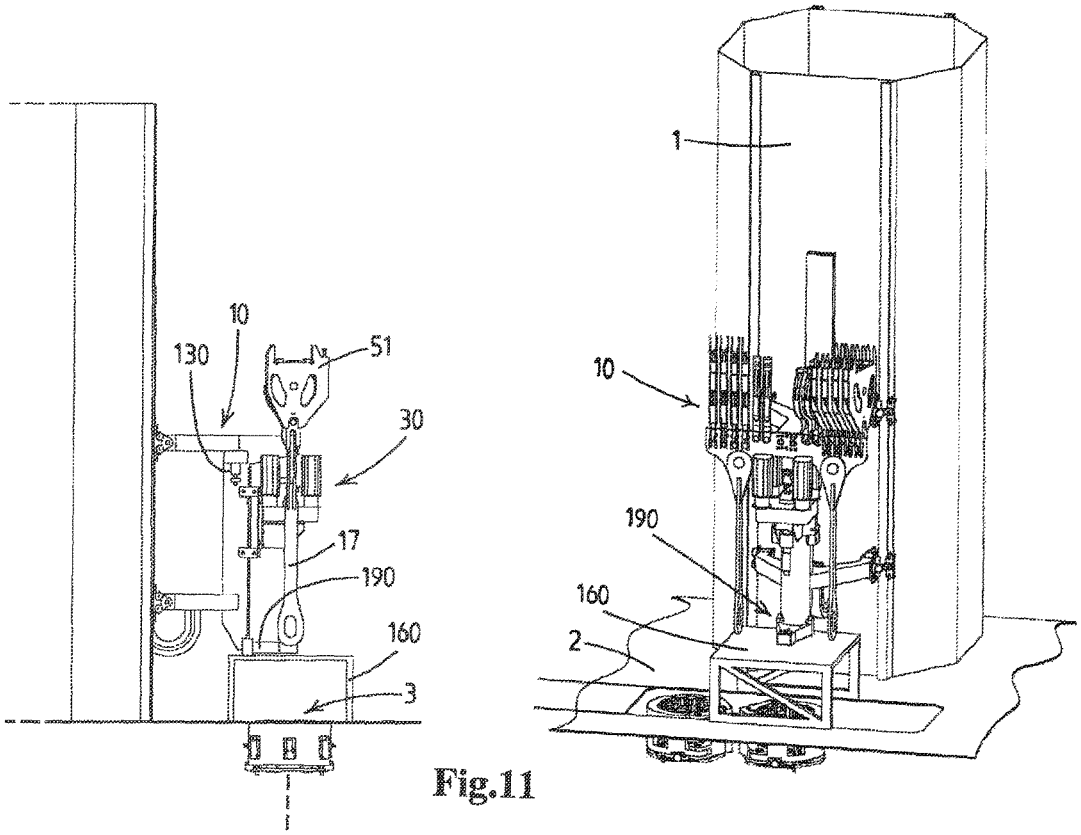

In FIG. 11 it can be seen that the trolley frame 10 is lowered so that the rails 13*a, b* thereof end just above or at the level of the cart 160.

After disconnecting any cables and/or hoses from the wrench and/or clamp device 190, this device190 is lowered along the frame member 13 by means of the auxiliary hoisting device 130 until it comes to rest on the cart 160.

Figure 12:
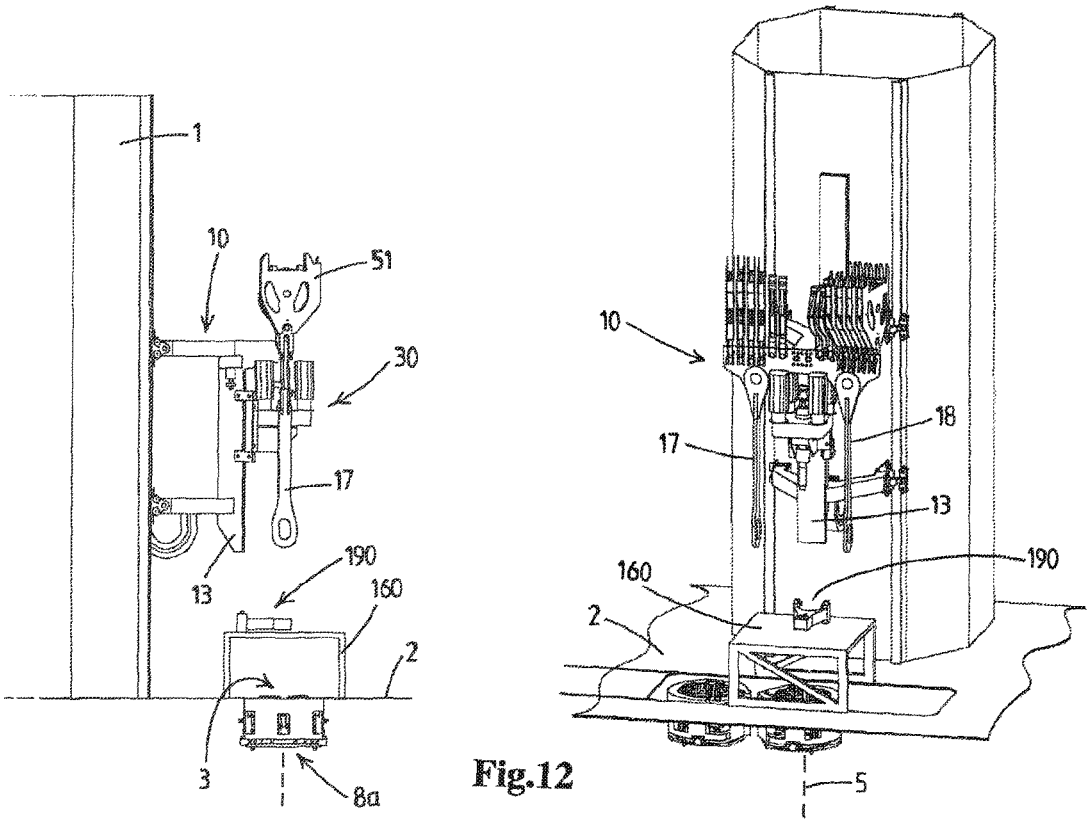

FIG. 12 depicts that the trolley 10 is lifted in order to disengage the wrench and/or clamp device from the rails of the trolley.

Figure 13:
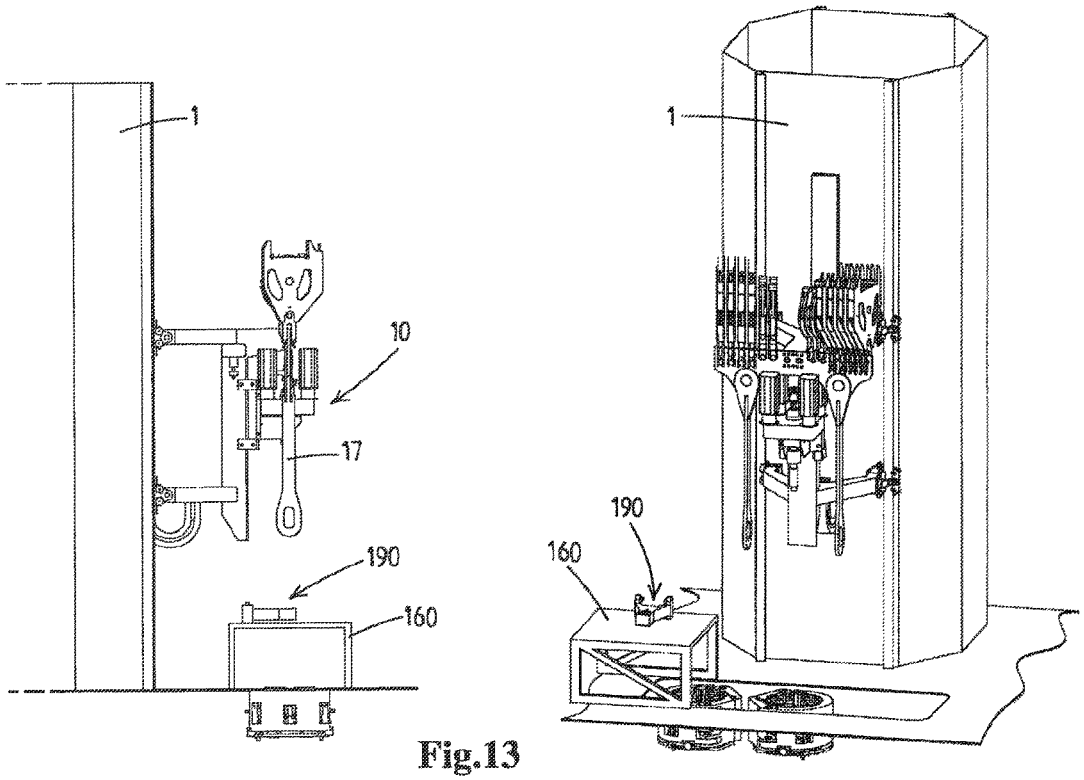

In FIG. 13 it is depicted that the cart 160 with the wrench and/or clamp device 190 thereon is moved away from the well center 3.

Figure 14:
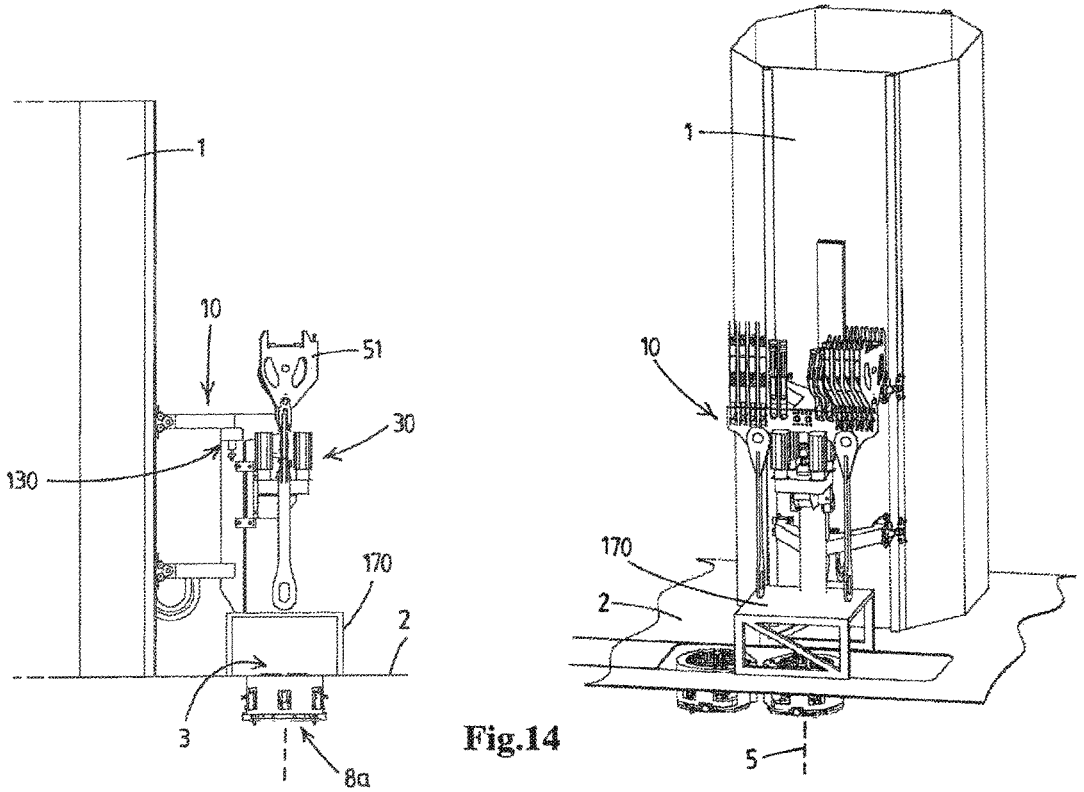

In FIG. 14 it is depicted that cart 170 has been moved over the well center 3, underneath the top drive device still in the frame of the trolley 10.

It is also depicted that any IBOP(s), saver subs, etc. present on the quill 36 have now been removed, prior to making the top drive device 30 to land on the cart 170.

The trolley 10 has been lowered so that so that the vertical guide rails 13*a, b* thereof end just above or at the level of the cart 170.

Figure 15:
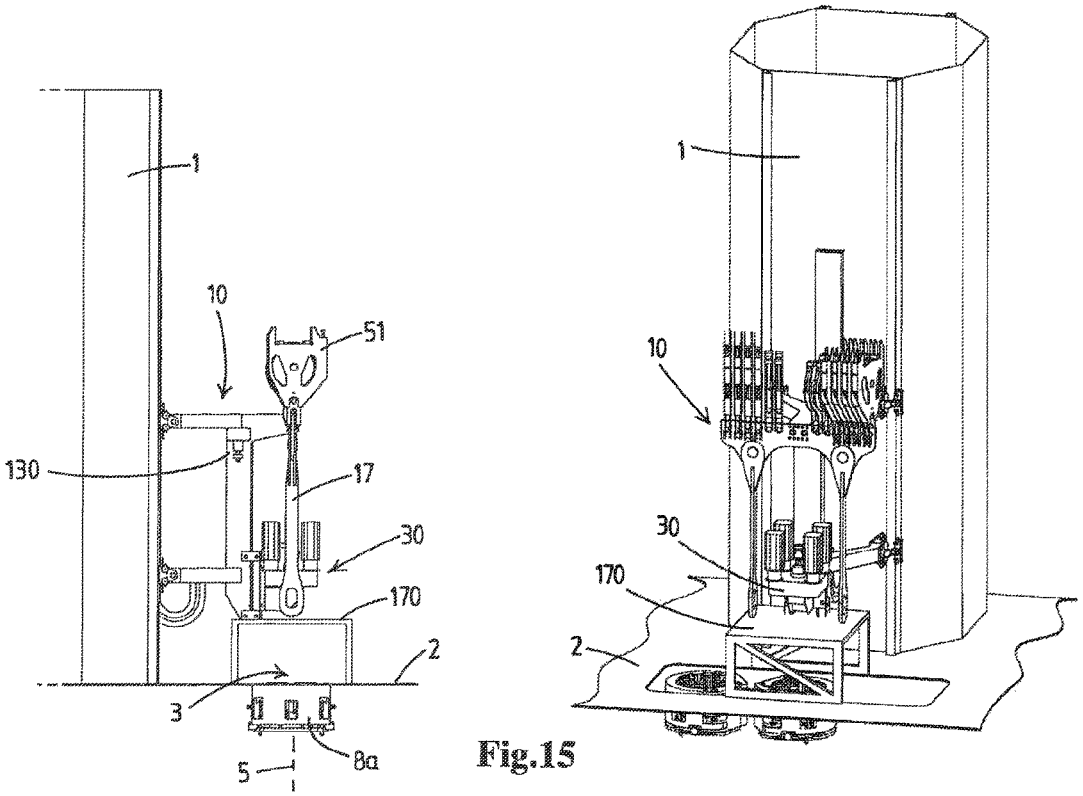

After having disconnected electrical cables, (mud) hoses, etc. from the top drive device 30, and disconnecting the actuator(s), the auxiliary hoisting device 130 is employed to lower the top drive device 30 along the frame member 13 and to land said top drive device 30 on the cart 170 as shown in FIG. 15.

Figure 16:
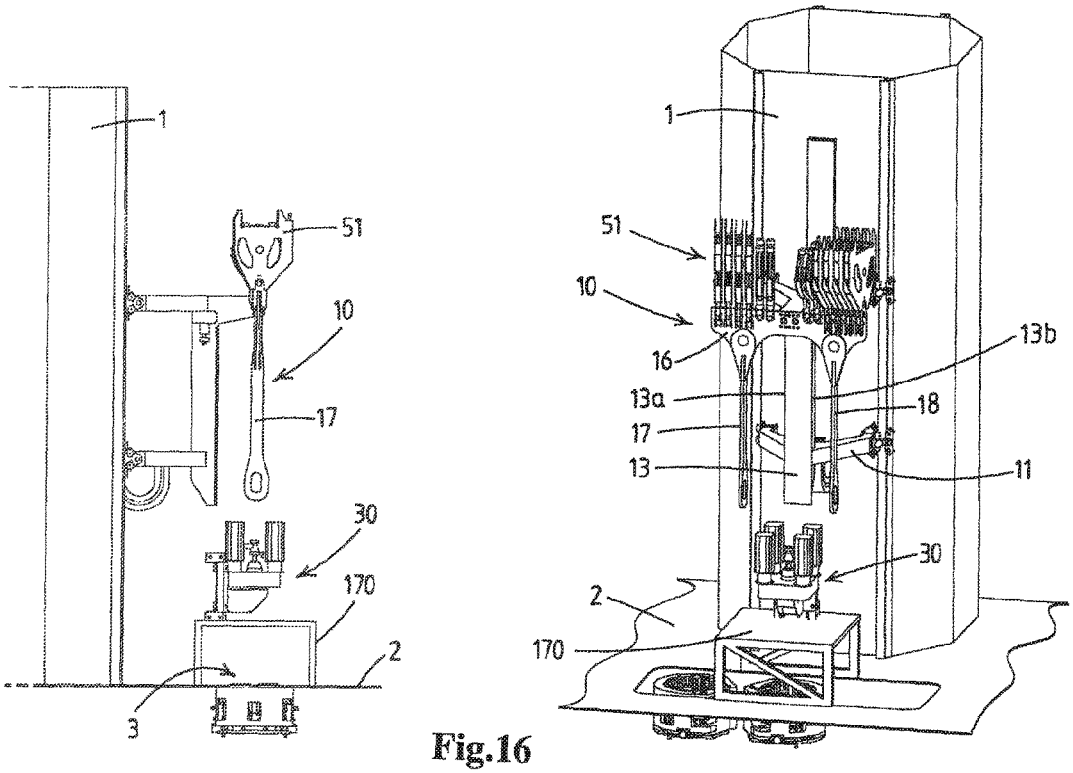

The FIG. 16 depicts that once the top drive device 30 has been brought to rest on the cart 170, the trolley 10 is hoisted to cause the top drive device guide members to become disengaged from the vertical guide rails 13*a, b* on the frame of trolley 10.

Now, as depicted in FIG. 17, the cart 170 with the top drive device 30 thereon can be moved away from the firing line 5, e.g. to a remote maintenance location, e.g. to a workshop onboard the vessel.

It will be appreciated that a spare or repaired top drive device, or another top drive device, can be installed in the trolley in the reverse manner.

FIG. 18 depicts an alternative trolley 310.

The trolley 310 is provided with a rigid frame 350 that supports the top drive device 30. Generally in the depicted preferred embodiment the frame 350 forms a rigid loop in a central vertical plane through the firing line 5 and perpendicular to the adjacent side of the mast and/or the plane through the rails 60, 61.

The frame 350 has a top frame member 351 that is suspended from one or more winch driven cables of the hoisting device 50. Here, as preferred, the top frame member 351 carries multiple travelling sheaves 51 in a side-by-side arrangement, with the sheaves 51 having a common, horizontal, axis of rotation. The one or more hoisting cables extend between these travelling sheaves 51 and sheaves of the crown block, from which the one or more cables pass to one or more winches (not shown). As is preferred a heave compensation mechanism is provided that acts on the one or more cables to afford heave compensation of the trolley 10 and the attached top drive device 30.

The frame comprises a releasable carrier 352, spaced below the top frame member 351, that is connected via a front frame member 353 and a rear frame member 354 to the top frame member 351.

As schematically shown it is provided for that the carrier 352 can be released from the lower end of the members 353, 354 in order to move the carrier, and the rotatable head clamp 140, away from underneath the top drive device 30.

The carrier 352 here extends perpendicular to the axis of rotation of the multiple sheaves 51 on the top frame member. This embodiment is e.g. advantageous in combination with a top drive device wherein two vertical axis electrical top drive motors 331 are arranged underneath a gearbox or transmission housing 333, e.g. a left-hand motor and a right-hand motor as shown.

The housing 333 is guided along the frame members 353, 354, e.g. by guide rails thereon, e.g. also absorbing reaction torque of the drive motors 331.

Here these motors 331, 332 are—in vertical projection—on opposed sides of the lower frame member 352.

The top drive device 30 is mounted within the frame 350 so as to be vertically mobile relative to the frame by one or more vertical displacement actuators, e.g. adapted to perform controlled lowering and raising of the top drive device during make up or breaking of the threaded connection between the quill 334 or rotary stem on the one hand and the tool joint or box member of the tubular suspended from the rotatable head clamp assembly 140 on the other hand.

The frame of the trolley and hoisting device 50 preferably have sufficient strength and capacity to also handle a weight of a subsea riser string when appropriate. For example a riser lifting tool can be attached to the vertical frame members 18, 19; 353, 354, e.g. after removal of the carrier 19, 352 and then attached to said vertical frame members.

It will be appreciated in general, that with the carrier 19, 352 removed other components may become suspended from the first and second vertical frame members of the trolley frame.

It will also be appreciated that, if desired, a common elevator device may be attached to the carrier 19, 352, e.g. for handling tubulars that are to be supplied by a catwalk machine.

FIG. 19 illustrates in plan view the drilling tower 1 with trolley rails 6,7. The trolley has been left out this figure. Further one sees the drill floor 2 and a driller's cabin 22.

Near the tower 1, here at opposed sides of the tower 1, one or more storage devices 110, 120 for storage of tubular stands are present. Here (as in FIG. 1) the storage devices 110, 120 are embodied as storage carrousels as is known in the art.

FIG. 19 also depicts racker devices 71, 72, 81, 82 that are embodied to move tubular stands between the tubular storage devices 110, 120 and the firing line 5. These racker devices may comprise multiple motion arm assemblies, e.g. a set of two above one another for each storage device 110, 120, wherein each motion arm assembly comprises a telescopic motion arm carrying a gripper, wherein said motion arm assemblies are movable over a respective vertical rail mounted on the tower 1. This arrangement is known in the art.

FIG. 19 illustrates that the rails 2*a*, 2*b* form a first cart rail section including a pair of parallel cart rails 2*a*, 2*b* passing along the well center of the drill floor. It is illustrated that a second cart rail section with parallel rails 2*c*, 2*d* is orthogonal to the first cart rail section, e.g. to extend along the mast 1. For example said first cart rail section extends transverse to the hull of a monohull drilling vessel and the second cart rail section extends along a side of the hull.

A further section of cart rails 2*e*, 2*f* is also depicted. By providing a grid of orthogonal cart rail sections, carts can be transported to various locations remote from the drill floor 2, e.g. to storage and/or maintenance locations for the various components.

FIG. 20 depicts schematically a tall and heavy well intervention structural frame component 400. As can be seen best in FIG. 21 this component 400 is adapted to be suspended from the trolley 10, in particular from the first and second vertical frame members 17, 18 thereof. In this example the component 400 has at its top end two hooks 401, 402 that are to be fitted into the eye of the respective member 17, 18.

For clarity FIG. 20 only shows part of the trolley 10.

The well intervention component 400 has a multistory structural frame that is provided with a coiled tubing injector 410, a wireline unit 420, and with associated pressure control devices 430, 440 at a lower level of the structural frame. For example the injector 410 and unit 420 are translatable between a position aligned with the firing line 5 and a remote non-operative position within the structural frame. Similarly the device 430, 440 may be embodied translatable or otherwise mobile between a non-operative position and a position aligned with the firing line 5.

FIG. 21 depicts that a tall firing line component, e.g. with a multistory structural frame as in the component 400, can be transported by means of a cart, in particular a skid cart 180 over rails 2*a, b* on the drill floor to a position underneath the trolley 10. Then the frame members 17, 18 of the trolley can be connected to the component 400 and the component lifted from the cart 180 that is then moved to a remote location.

For example with a well intervention component it may be envisaged that the main hoisting device is operated in heave compensation mode, so that the component, e.g. with coiled tubing injector, moves up and down along the tower to counteract the sea state induced motion of an offshore drilling vessel on which the tower 1 is arranged.

The invention claimed is:

1. A method for operating a wellbore drilling installation for drilling a wellbore or other wellbore related activities, said installation comprising:

a drilling tower;

a drill floor having a well center allowing the passage of a drilling tubulars string along a firing line into the wellbore;

at least one vertical trolley rail;

a trolley, said trolley being guided along said at least one vertical trolley rail;

a main hoisting device adapted to lift and lower said trolley along said at least one vertical trolley rail relative to the drilling tower; and a top drive device attached to the trolley, said top drive device comprising one or more top drive motors in order to impart rotary motion to a drilling tubulars string when connected to said top drive device, wherein the trolley comprises a frame with:

a top frame member suspended from said main hoisting device; and a first vertical frame member and a second vertical frame member, each connected at an upper end thereof to said top frame member, said first and second vertical frame members depending from said top frame member spaced apart from one another and being adapted to support the load of a drilling tubulars string that passes along said firing line into the wellbore, wherein each of said first and second vertical frame members comprises a lower connector member, said lower connector member being:

connected to a component that is adapted to be suspended from the first and second vertical frame members; or adapted to be connected to a component that is adapted to be suspended from the first and second vertical frame members, wherein said top drive device is attached to the frame of the trolley independent from the first and second vertical frame members, wherein said installation further comprises one or more components each adapted to be releasably connected to and suspended from said first and second vertical frame members of the trolley, said one or more components at least including:

a thrust bearing component provided with a thrust bearing that is adapted to support the load of a drilling tubulars string, so that said load is transmitted via said thrust bearing component to said first and second vertical frame members and thereby to said top frame member suspended from said main hoisting device, wherein the trolley is further provided with a wrench and/or clamp device that is mounted on the frame of the trolley independent from the top drive device and from the one or more components connected to and suspended from the first and second vertical frame members, at a location below the top drive device and above the one or more components, wherein said installation further comprises one or more carts, each adapted to transport a component to be suspended from the first and second vertical frame members, wherein each cart is adapted to be positioned on the drill floor underneath the trolley, the method including a routine for removal of a component suspended from said first and second vertical frame members and removal of the top drive device, the routine including the steps of:

positioning a first cart of the one or more carts on the drill floor underneath the trolley;

lowering the trolley by the main hoisting device and bringing the component to rest on said first cart;

releasing the component from the lower connector members of the first and second vertical frame members; and moving away said first cart with the released component to a first remote location, positioning a second cart of the one or more carts on the drill floor underneath the trolley;

lowering the wrench and/or clamp device relative to said frame of said trolley and bringing the wrench and/or clamp device to rest on said second cart;

moving said second cart with said lowered and disengaged wrench and/or clamp device resting thereon to said first remote location or a second remote location;

positioning a third cart of the one or more carts on the drill floor underneath the trolley;

lowering the top drive device relative to said frame of said trolley until said top drive device disengages from said one or more vertical guide rails and the bringing the top drive device to rest on said third cart; and moving said third cart with said lowered and disengaged top drive device resting thereon to said first remote location or to said second remote location or to a third remote location.

2. The method according to claim 1, for performing casing running, including the step of releasing or coupling one or more of the following components from or with the lower connector members of the first and second vertical frame members of the trolley:

a casing running tool; and a casing drive tool.

3. The method according to claim 1, including the steps of:

connecting a rotatable head clamp assembly carrier of the thrust bearing component to said lower connectors of said first and second vertical frame members;

supporting a rotatable head clamp assembly of the thrust bearing component by said rotatable head clamp assembly carrier, which rotatable head clamp assembly is provided with an open-centered rotary body with a vertical passage there through;

axially retaining the top end of the drilling tubular whilst the top end of the tubular remains accessible for a quill or rotary stem of the top drive device by a retainer assembly of the rotatable head clamp assembly; and supporting the load of the drilling tubulars string during a drilling process, when the quill or rotary stem of the top drive device is connected to the top end of the drilling string by a thrust bearing of the rotatable head clamp assembly.

4. The method according to claim 1, wherein the top drive device is vertically displaceable relative to the frame of the trolley and wherein the trolley is provided with an auxiliary hoisting device adapted to vertically move at least the top drive device relative to the frame, the method comprising the step of vertically moving at least the top drive device relative to the frame of the trolley.

5. The method according to claim 1, wherein the first and second vertical frame members are embodied each as a pivotal link member, of which the upper end is pivotally connected to the top frame member so that the pivotal link members are pivotal in a common transverse plane that encompasses the firing line.

6. The method according to claim 1, wherein the frame of the trolley has one or more vertical guide rails, wherein the top drive device has cooperating guide members, that cooperate with said one or more vertical guide rails, and wherein one or more of said components comprise a guidance portion that cooperates with said same one or more vertical guide rails.

7. The method according to claim 1, wherein the installation comprises a pair of parallel vertical trolley rails, and wherein said trolley comprises a rigid frame structure having an upper and lower trolley beam which are vertically spaced from another and are each equipped at ends thereof with rollers engaging the respective trolley rails, wherein the upper and lower trolley beam are rigidly interconnected by one or more rear frame members, wherein the rigid frame structure further comprises a forward cantilevered frame member extending forward from a top end of said one or more rear frame members, and wherein said forward cantilevered frame member carries a transverse horizontal top frame member in a transverse plane that encompasses the firing line, and wherein said first and second vertical frame members are each connected at an upper end thereof to said top frame member, said first and second vertical frame members depending from said top frame member spaced apart from one another and being adapted to support the load of a drilling tubulars string that passes along said firing line into the wellbore.

8. The method according to claim 1, wherein said top frame member is provided with connectors for connecting thereto a series of cable sheaves in a side by side arrangement, and wherein the drilling tower is provided with a crown block having cable sheaves so that the trolley is suspended by one or more winch driven cables in a multiple fall arrangement.

9. The method according to claim 1, wherein at least one of said carts is embodied with a straddling structure having a top structure embodied to support one or more of said components and with a raised straddle frame, allowing to place the cart over the well center, and over a stick-up portion of a drilling string held by a slip device.

10. The method according to claim 3, for performing a drilling process, including the steps of:

suspending the drilling tubulars string from the thrust bearing component so that the load of the drilling tubulars string is transferred via the thrust bearing of the thrust bearing component to the first and second vertical frame members and thereby to said top frame member suspended from said main hoisting device; and connecting a rotary output member of the top drive device to the top end of the suspended drilling tubulars string to impart rotary motion to said string.

11. The method according to claim 1, for performing a coiled tubing process in a wellbore, including the step of connecting a coiled tubing injector to the first and second vertical frame members of the trolley.

12. The method according to claim 1, for upending of a riser section to be added to a riser string and/or for lifting and lowering a riser string in subsea wellbore related activities, including the step of connecting a riser lifting tool to the first and second vertical frame members of the trolley.

13. The method according to claim 1, wherein the method further includes a routine for mounting of the component to be suspended from said first and second vertical frame members of the trolley including the steps of:

moving said first cart carrying the component from the first remote location to a position on the drill floor underneath the trolley;

coupling said component with the lower connector members of the first and second vertical frame members;

lifting the component from said first cart; and moving said empty first cart to the first remote location or the second remote location.

* * * * *